US009252473B2

(12) United States Patent
Terada et al.

(10) Patent No.: US 9,252,473 B2
(45) Date of Patent: Feb. 2, 2016

(54) ELECTROMAGNETIC WAVE PROPAGATION MEDIUM

(75) Inventors: Takahide Terada, Tokyo (JP); Hiroshi Shinoda, Kodaira (JP); Kazunori Hara, Higashikurume (JP)

(73) Assignee: HITACHI, LTD., Tokyo (JP)

( * ) Notice: Subject to any disclaimer, the term of this patent is extended or adjusted under 35 U.S.C. 154(b) by 250 days.

(21) Appl. No.: 13/884,605

(22) PCT Filed: Mar. 14, 2011

(86) PCT No.: PCT/JP2011/055918

§ 371 (c)(1),
(2), (4) Date: May 9, 2013

(87) PCT Pub. No.: WO2012/124040

PCT Pub. Date: Sep. 20, 2012

(65) Prior Publication Data

US 2013/0229240 A1 Sep. 5, 2013

(51) Int. Cl.

| | |
|---|---|
| ***H01P 5/12*** | (2006.01) |
| ***H01P 3/12*** | (2006.01) |
| ***H01Q 13/22*** | (2006.01) |

(52) U.S. Cl.
CPC . *H01P 3/12* (2013.01); *H01Q 13/22* (2013.01)

(58) Field of Classification Search
None
See application file for complete search history.

(56) References Cited

U.S. PATENT DOCUMENTS

| | | | | |
|---|---|---|---|---|
| 2,573,746 | A * | 11/1951 | Watson et al. | 343/771 |
| 2,596,480 | A * | 5/1952 | Guptill et al. | 343/771 |
| 3,328,800 | A * | 6/1967 | Algeo | 343/768 |
| 2004/0051463 | A1 | 3/2004 | Sakamoto et al. | |
| 2005/0140556 | A1 | 6/2005 | Ohno et al. | |
| 2011/0221547 | A1 | 9/2011 | Tezuka et al. | |

FOREIGN PATENT DOCUMENTS

| | | | |
|---|---|---|---|
| JP | 05-226927 | A | 9/1993 |
| JP | 10-107538 | A | 4/1998 |
| JP | 2002-280196 | A | 9/2002 |
| JP | 2003-318649 | | 11/2003 |
| JP | 2005-317462 | A | 11/2005 |
| JP | 2010-114696 | A | 5/2010 |
| WO | WO 2012/029472 | A1 | 3/2012 |

OTHER PUBLICATIONS

Richard C. Johnson, "Antenna Engineering Handbook", Third Edition, McGraw-Hill, Inc., Jul. 22, 1999, pp. 9-20-9-25.

* cited by examiner

*Primary Examiner* — Robert Pascal
*Assistant Examiner* — Kimberly Glenn
(74) *Attorney, Agent, or Firm* — Miles & Stockbridge P.C.

(57) ABSTRACT

When a wavelength of an electromagnetic wave in an electromagnetic wave propagation space (4) is λ, and n is an integer, in a case where a first conductive layer (2) and a second conductive layer (3) are short-circuited in a first end surface (7*b*), the more distant an electromagnetic wave output interface (6) is from an electromagnetic wave input interface (5), the closer to a distance of λ/4+n·λ/2 from the first end surface (7*b*) which is short-circuited the electromagnetic wave output interface is installed, and, in a case where the first conductive layer (2) and the second conductive layer (3) are not short-circuited in the first end surface (7*b*), the more distant the electromagnetic wave output interface (6) is from the electromagnetic wave input interface (5), the closer to a distance of n·λ/2 from the first end surface (7*b*) which is not short-circuited the electromagnetic wave output interface is installed.

20 Claims, 25 Drawing Sheets

ELECTROMAGNETIC WAVE PROPAGATION MEDIUM

TECHNICAL FIELD

The invention relates to an electromagnetic wave propagation medium such as a waveguide tube propagating an electromagnetic wave therethrough or an electromagnetic wave transmission sheet, and particularly to a technique suitable to be applied to an electromagnetic wave propagation medium in which there is an influence of a standing wave and a plurality of interfaces.

BACKGROUND ART

For example, JP-A-2010-114696 (PTL 1) discloses an electromagnetic wave transmission sheet having a mesh-like electrode, in which the length of a width perpendicular to a traveling direction of a transmitted electromagnetic wave is almost equal to a natural number multiple of half of the wavelength of the transmitted electromagnetic wave so as to be in a resonating state in a vertical direction.

In addition, JP-A-2005-317462 (PTL 2) discloses a plasma treatment device which includes a waveguide tube for electromagnetic wave distribution which propagates an electromagnetic wave therethrough, and a plurality of waveguide tubes for electromagnetic wave radiation branched from the waveguide tube for electromagnetic wave distribution and respectively provided with a plurality of slots. Further, a plurality of power supply windows make the waveguide tube for electromagnetic wave distribution be communicated with the respective waveguide tubes for electromagnetic wave radiation, and each power supply window is set such that an opening width increases in a direction toward the electromagnetic wave propagation direction side and such that a central axis parallel to the longitudinal direction of the waveguide tube for electromagnetic wave radiation is offset in the electromagnetic wave propagation direction side with respect to a central axis of a corresponding waveguide tube for electromagnetic wave radiation in a direction toward the opposite side of the electromagnetic wave propagation direction side.

In addition, JP-A-2002-280196 (PTL 3) discloses a plasma generating device in which a plurality of coupling holes are provided in waveguide tubes disposed in a plasma generating chamber, coupling factors of the coupling holes which are sequentially located toward the front end side of the waveguide tubes are increased one by one, and a plurality of dielectric windows corresponding to the respective coupling holes of the waveguide tube are provided in the plasma generating chamber. In addition, it is disclosed that an interval of the coupling holes is set to $(2n+1)\cdot\lambda g/2$, and an interval between a selected coupling hole and a short-circuited plate of the front end of the waveguide tube is set to $\lambda g/4$. Here, $\lambda g$ is an in-tube wavelength of the waveguide tube, and n is an integer.

CITATION LIST

Patent Literature

[PTL 1] JP-A-2010-114696
[PTL 2] JP-A-2005-317462
[PTL 3] JP-A-2002-280196

SUMMARY OF INVENTION

Technical Problem

The electromagnetic wave transmission sheet disclosed in PTL 1 has an electromagnetic wave absorbing medium which reduces reflection in the traveling direction of a propagated electromagnetic wave in order to realize stable communication. However, when the electromagnetic wave absorbing medium is used, manufacturing costs increase, and use efficiency of power used in communication is reduced.

In addition, in the plasma treatment device disclosed in PTL 2, among a plurality of slots provided in each of the waveguide tubes for electromagnetic wave radiation, the area of a slot (matching slot) provided at a position which is the most distant from the waveguide tube for electromagnetic wave distribution is set to be larger than the area of the other slots. Thereby, extra electromagnetic waves which cannot be distributed to each slot of the waveguide tubes for electromagnetic wave radiation are emitted into the treatment chamber through the matching slot, so as to suppress influence of an electromagnetic wave (reflected wave) which is reflected from the terminal end of the waveguide tube for electromagnetic wave radiation. However, the extra electromagnetic waves are emitted into the treatment chamber which is different from a space into which the electromagnetic waves should have been originally emitted, and thus use efficiency of power is low.

For this reason, an electromagnetic wave propagation medium which can realize stable communication without using the electromagnetic wave absorbing medium or a matching box is desirable.

In addition, as disclosed in PTL 1, in a case where a plurality of communication devices are arranged on the electromagnetic wave transmission sheet, when power, such as a communication signal, is input from an electromagnetic wave interface, a communication device close to the electromagnetic wave interface can receive large power. However, a communication device distant from the electromagnetic wave interface is robbed of power by the communication devices in the middle, and thus there is a problem in that it is hard for power to arrive there. For this reason, it is difficult to perform communication with multiple terminals and uniform power distribution.

In contrast, as disclosed in PTL 2 and PTL 3, if the slot is set such that the size thereof increases in the electromagnetic wave propagation direction of the slot, that is, toward the opposite side of the electromagnetic wave interface of the electromagnetic wave transmission sheet, power easily arrives at the communication device located at a position distant from the electromagnetic wave interface. However, in a case where a slot size is adjusted, if the number of communication devices increases, for example, since a difference between a large-sized slot and a small-sized slot becomes considerable, there are problems in that the electromagnetic wave transmission sheet is required to be processed finely, the electromagnetic wave transmission sheet becomes large, an installation interval of communication devices increases, and a large communication device is necessary in order to correspond to the large-sized slot.

In addition, the configuration in which the power supply window disclosed in PTL 2 is offset in the electromagnetic wave propagation direction is means for adjusting a phase difference between electromagnetic waves which are output from the respective power supply windows, does not contribute to solving the above-described problems.

An object of the invention is to provide an electromagnetic wave propagation medium which realizes stable communication.

In addition, an object of the invention is to provide an electromagnetic wave propagation medium which enables power to easily arrive even at a position distant from an electromagnetic wave interface.

The above-described and other objects and new features of the invention will become apparent from the description of the present specification and the accompanying drawings.

Solution to Problem

Among the inventions disclosed in the present applications, a brief description of an outline of the representative inventions will be made as follows.

The invention can provide an electromagnetic wave propagation medium which realizes stable communication without using an electromagnetic wave absorbing medium or a matching box. In addition, the invention can provide an electromagnetic wave propagation medium which enables power to easily arrive even at a position distant from an electromagnetic wave interface without adjusting a slot size.

Advantageous Effects of Invention

Among the inventions disclosed in the present application, a brief description of effects which can be achieved by the representative inventions will be made as follows.

An electromagnetic wave propagation medium includes a first conductive layer; a second conductive layer; an electromagnetic wave propagation space that is interposed between the first conductive layer and the second conductive layer on upper and lower sides; at least one electromagnetic wave input interface; a plurality of electromagnetic wave output interfaces; long sides in a first direction in which an electromagnetic wave is propagated; short sides in a second direction perpendicular to the first direction; two first end surfaces along the short sides opposite to each other with the electromagnetic wave propagation space interposed therebetween; and two second end surfaces along the long sides opposite to each other with the electromagnetic wave propagation space interposed therebetween, wherein, when a wavelength of the electromagnetic wave in the electromagnetic wave propagation space is $\lambda$, and n is an integer, in a case where the first conductive layer and the second conductive layer are short-circuited in a first end surface which reflects the electromagnetic wave among the first end surfaces and the second end surfaces, the more distant the electromagnetic wave output interface is from the electromagnetic wave input interface, the closer to a distance of $\lambda/4+n\cdot\lambda/2$ from the first end surface which is short-circuited the electromagnetic wave output interface is installed, and in a case where the first conductive layer and the second conductive layer are not short-circuited in the first end surface which reflects the electromagnetic wave, the more distant the electromagnetic wave output interface is from the electromagnetic wave input interface, the closer to a distance of $n\cdot\lambda/2$ from the first end surface which is not short-circuited the electromagnetic wave output interface is installed.

DESCRIPTION OF EMBODIMENTS

Figure 1:
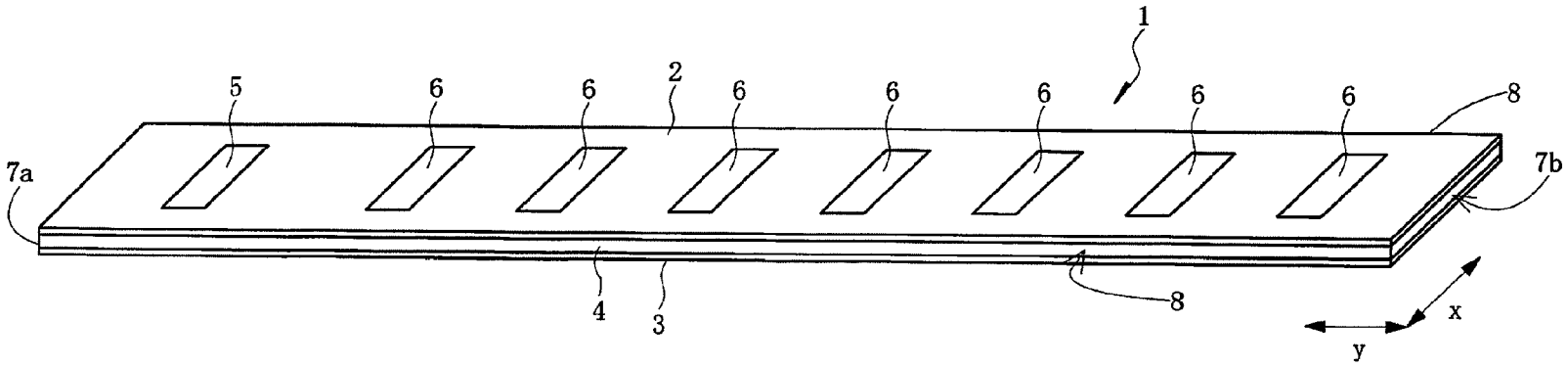
FIG. 1 is a schematic diagram illustrating an overall configuration of an electromagnetic wave propagation medium according to Embodiment 1 of the invention.

In the following embodiments, if necessary for convenience, a plurality of separate sections or embodiments will be described; however, except for a case of being particularly explicitly mentioned, they are not unrelated to each other, but one is related to some of or all modified examples, details, supplementary descriptions, or the like, of the other.

In addition, in the following embodiments, when the number of constituent elements (including the number, numerical values, amount, range, and the like) and the like are described, except for a case of being particularly explicitly mentioned and being limited to a specific number clearly in principle, the invention is not limited to the specific number, and the specific number or more or the specific number or less is possible. Further, in the following embodiments, except for a case of being particularly explicitly mentioned and being considered to be essential in principle, a constituent element (including an element of a step and the like) is not necessarily essential. Similarly, in the following embodiments, when a shape, a positional relationship, and the like of a constituent element are described, except for a case of being particularly explicitly mentioned and being considered not to be so clear in principle, ones which are substantially approximate or similar to the shape and the like are included. This is also the same for the numerical value and range.

In addition, in the following embodiments, when a "conductor" is described, the conductor indicates an electric conductor at an electromagnetic wave frequency band used for propagation of an electromagnetic wave, and, when an "electromagnetic wave propagation space" is described, it indicates a dielectric at an electromagnetic wave frequency band used for propagation of an electromagnetic wave. Therefore, no direct limitation is placed, for example, on whether there is a conductor, a semiconductor, or an insulator with respect to a DC current. In addition, the conductor and the dielectric are defined by characteristics thereof in relation to an electromagnetic wave, and are not limited in an aspect such as a solid, a liquid, and a gas, or a constituent material.

In addition, in the drawings used in the following embodiments, even a plan view or a perspective view may be hatched for easy viewing. In addition, in all the drawings for describing the following embodiments, constituent elements having the same function are given the same reference numerals in principle, and repeated description thereof will be omitted. Hereinafter, the embodiments of the invention will be described in detail with reference to the drawings.

Embodiment 1

Figure 2:
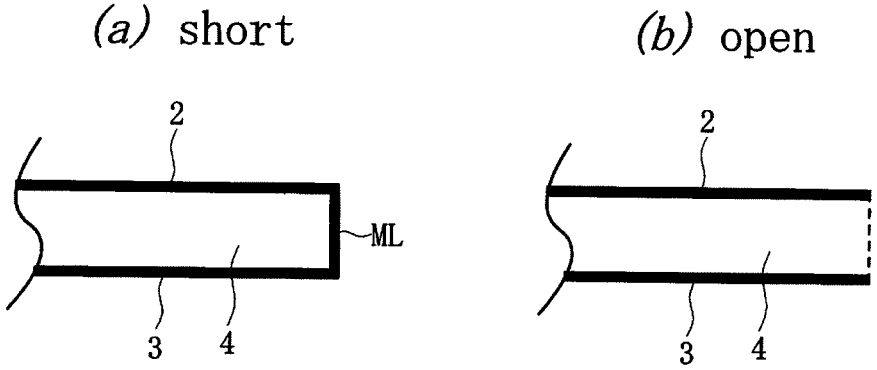
FIG. 2 is a cross-sectional view illustrating an enlarged end portion of the electromagnetic wave propagation medium according to Embodiment 1 of the invention, where (*a*) shows an end portion in a short-circuited state and (*b*) shows an end portion in an open-circuited state.
Figure 3:
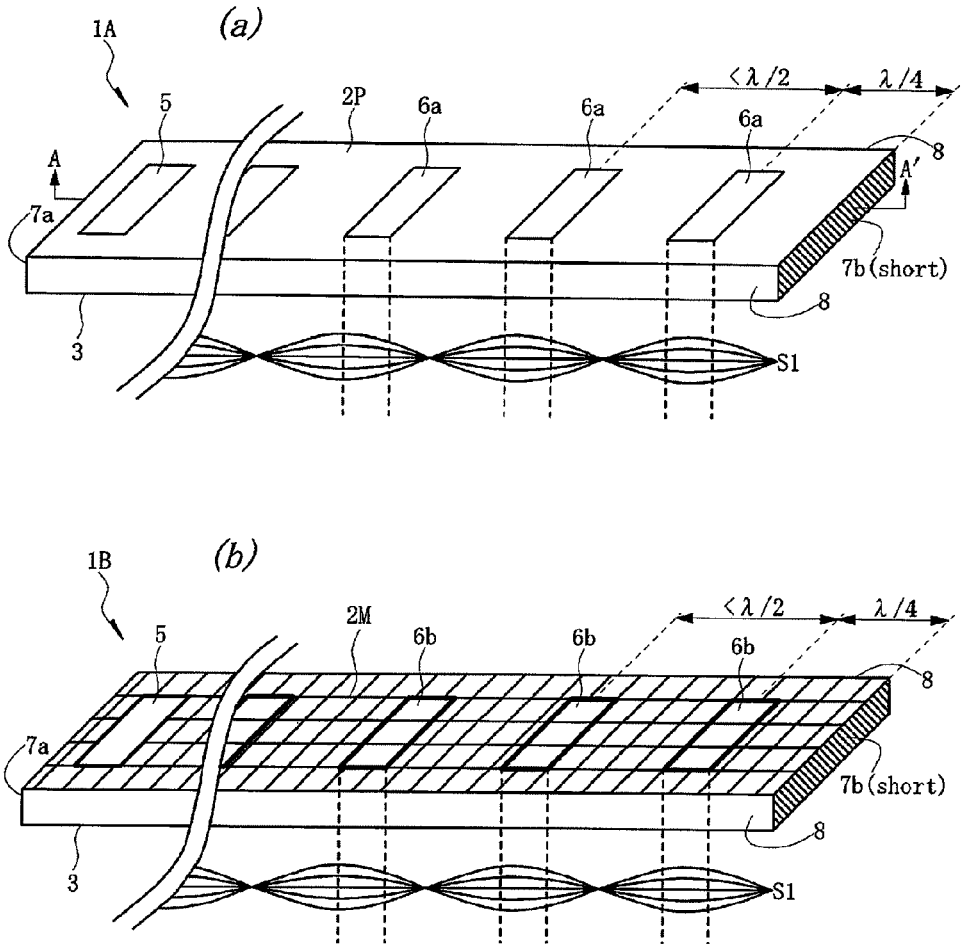
FIG. 3 is a perspective view illustrating enlarged main portions of the electromagnetic wave propagation medium according to Embodiment 1 of the invention, where (*a*) is a perspective view illustrating a first electromagnetic wave propagation medium including a first conductive layer with a plate shape, and (*b*) is a perspective view illustrating a second electromagnetic wave propagation medium including a first conductive layer with a mesh shape.
Figure 4:
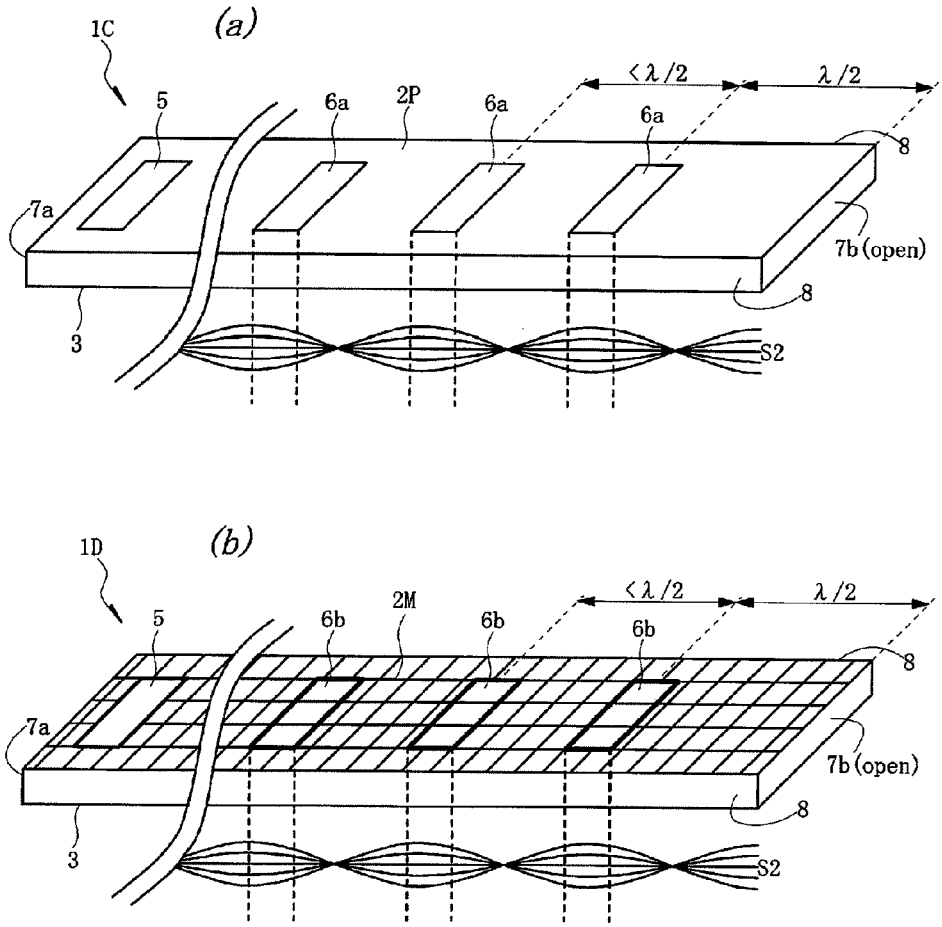
FIG. 4 is a perspective view illustrating enlarged main portions of the electromagnetic wave propagation medium according to Embodiment 1 of the invention, where (*a*) is a perspective view illustrating a third electromagnetic wave propagation medium including a first conductive layer with a plate shape, and (*b*) is a perspective view illustrating a fourth electromagnetic wave propagation medium including a first conductive layer with a mesh shape.
Figure 5:
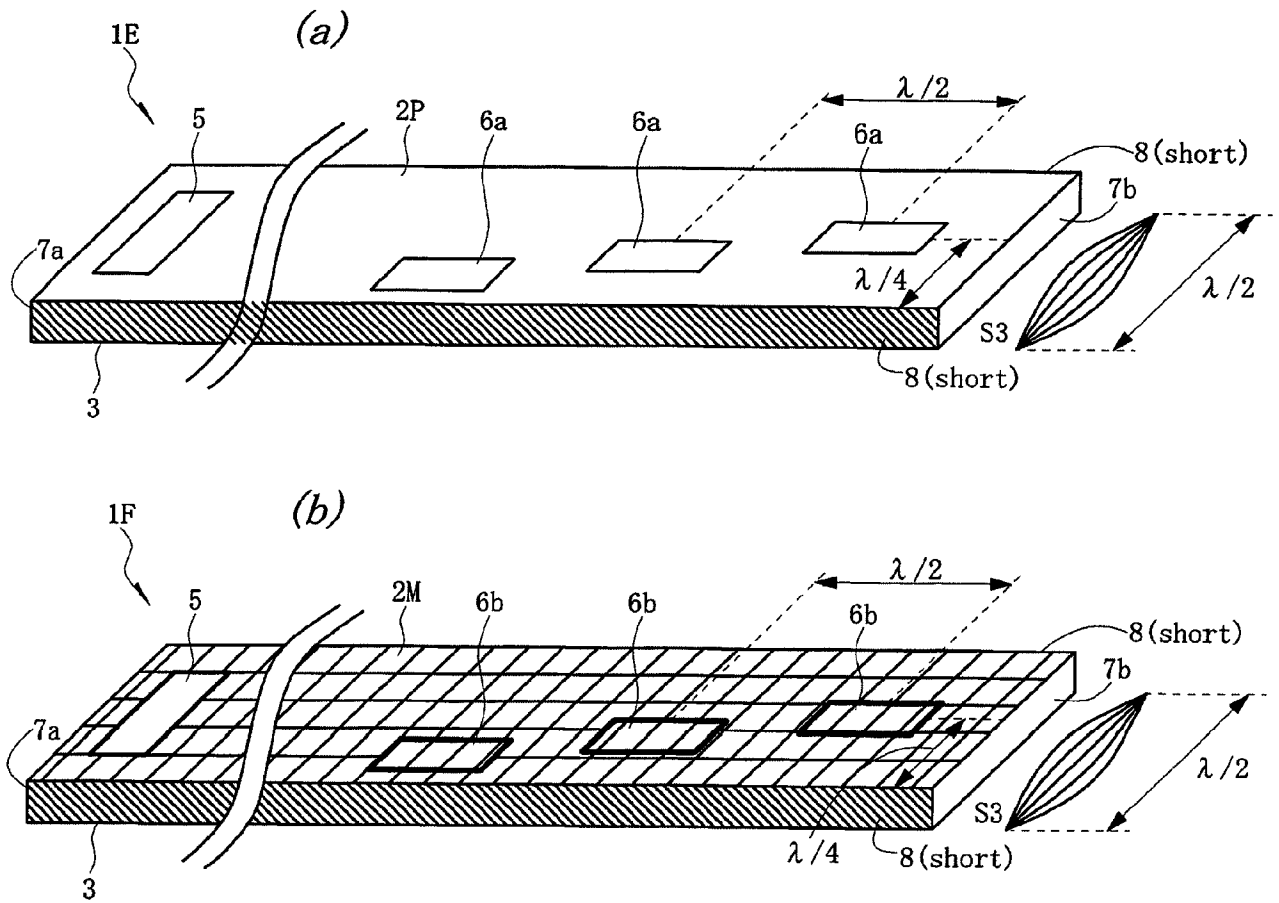
FIG. 5 is a perspective view illustrating enlarged main portions of the electromagnetic wave propagation medium according to Embodiment 1 of the invention, where (*a*) is a perspective view illustrating a fifth electromagnetic wave propagation medium including a first conductive layer with a plate shape, and (*b*) is a perspective view illustrating a sixth electromagnetic wave propagation medium including a first conductive layer with a mesh shape.
Figure 6:
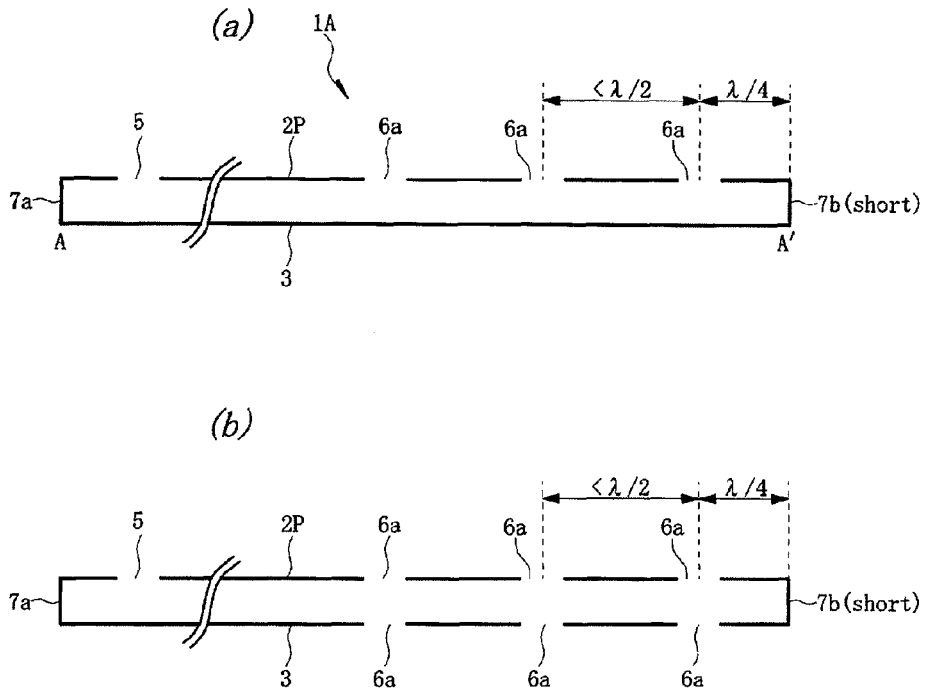
FIG. 6 is a cross-sectional view enlarging main portions in a direction in which a long side of the electromagnetic wave propagation medium according to Embodiment 1 of the invention extends, where (*a*) is a cross-sectional view illustrating a case where electromagnetic wave output interfaces are installed only in a conductor of the upper surface, and (*b*) is a cross-sectional view illustrating a case where electromagnetic wave output interfaces are installed in a conductor of the upper surface and a conductor of the lower surface.
Figure 7:
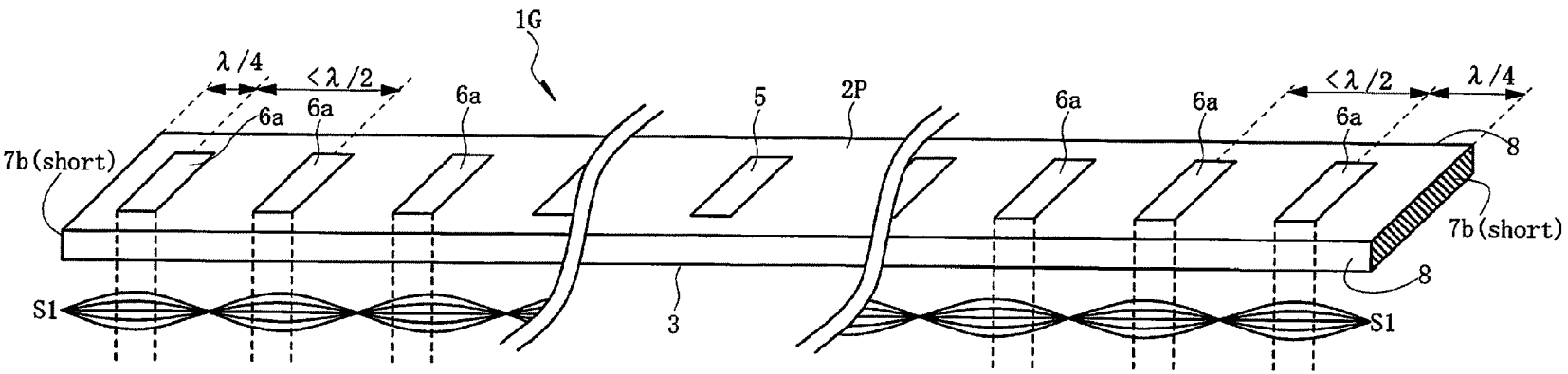
FIG. 7 is a perspective view illustrating enlarged main portions of a seventh electromagnetic wave propagation medium which is a modified example of the first electromagnetic wave propagation medium according to Embodiment 1 of the invention.
Figure 8:
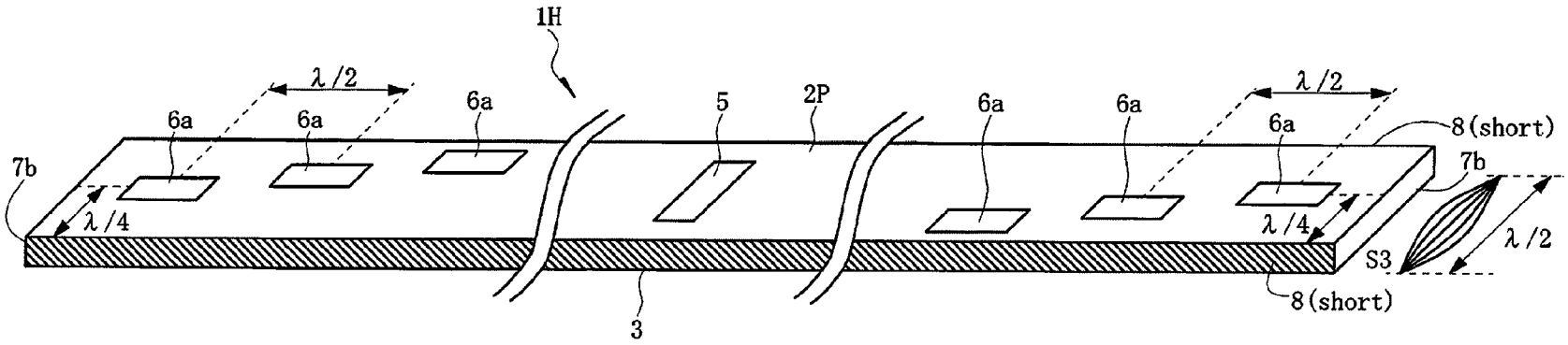
FIG. 8 is a perspective view illustrating enlarged main portions of an eighth electromagnetic wave propagation medium which is a modified example of the fifth electromagnetic wave propagation medium according to Embodiment 1 of the invention.
Figure 9:
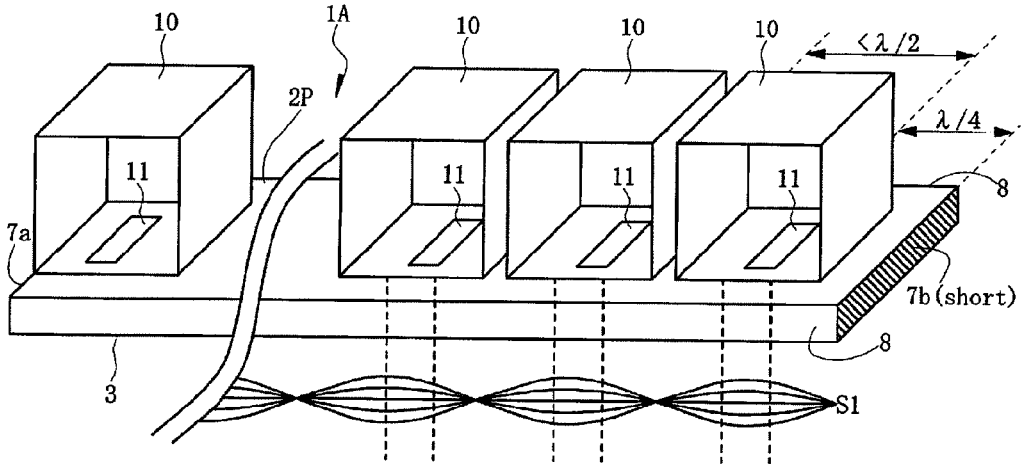
FIG. 9 is a perspective view illustrating enlarged main portions of the electromagnetic wave propagation medium in which communication devices are installed according to Embodiment 1 of the invention.

An electromagnetic wave propagation medium according to Embodiment 1 will be described with reference to FIGS. 1 to 9. FIG. 1 is a schematic diagram illustrating an overall configuration of an electromagnetic wave propagation medium; FIG. 2 is a cross-sectional view illustrating an enlarged end portion of the electromagnetic wave propagation medium; FIGS. 3 to 5 are perspective views illustrating enlarged main portions of the electromagnetic wave propagation medium; FIG. 6 is a cross-sectional view illustrating enlarged main portions of the electromagnetic wave propagation medium; FIGS. 7 and 8 are perspective views illustrating enlarged main portions of the electromagnetic wave propagation medium; and FIG. 9 is a perspective view illustrating enlarged main portions of the electromagnetic wave propagation medium in which communication devices are installed.

As shown in FIG. 1, an electromagnetic wave propagation medium 1 has a structure in which a planar electromagnetic wave propagation space 4 is interposed between a first conductive layer 2 and a second conductive layer 3 on upper and lower sides, and includes at least one electromagnetic wave input interface 5 and a plurality of electromagnetic wave output interfaces 6 provided in the first conductive layer 2. In addition, the electromagnetic wave propagation medium 1 has a strip shape with a long side in a traveling direction (a first direction; an x direction shown in FIG. 1) of a propagated electromagnetic wave and a short side in a direction (a second direction perpendicular to the first direction; a y direction shown in FIG. 1) perpendicular to the traveling direction of the electromagnetic wave.

In addition, the first conductive layer 2 and the second conductive layer 3 are short-circuited or open-circuited in two lateral surfaces (first end surfaces) 7*a* and 7*b* of the electromagnetic wave propagation space 4 in the direction in which the short sides extend and two lateral surfaces (second end surfaces) 8 and 8 of the electromagnetic wave propagation space 4 in a direction in which the long sides extend, and an electromagnetic wave can be reflected in the first end surfaces 7*a* and 7*b* and the second end surfaces 8 and 8. Here, the term "short-circuited" indicates a state in which a conductive layer ML is formed at the lateral surface of the electromagnetic wave propagation space 4 and thus the first conductive layer 2 and the second conductive layer 3 are connected to each other as shown in FIG. 2(*a*), and the term "open-circuited" indicates a state in which a conductive layer ML is not formed at the lateral surface of the electromagnetic wave propagation space 4 and thus the first conductive layer 2 and the first conductive layer 3 are not connected to each other as shown in FIG. 2(*b*).

In addition, in the electromagnetic wave propagation medium 1, the electromagnetic wave input interface 5 is provided at a position close to one first end surface 7*a*, and the electromagnetic wave output interfaces 6 are not provided between the electromagnetic wave input interface 5 and one first end surface 7*a*. In contrast, a plurality of electromagnetic wave output interfaces 6 are provided between the electromagnetic wave input interface 5 and the other first end surface 7*b* located at a position distant from the electromagnetic wave input interface 5.

The size of the short side of the electromagnetic wave propagation medium 1 is ½ of a wavelength of a propagated electromagnetic wave, and the thickness of the electromagnetic wave propagation space 4 is set to be smaller than a wavelength of a propagated electromagnetic wave. For example, in a case of using a frequency of 2.4 GHz band, if a dielectric constant of the electromagnetic wave propagation space is 1, a wavelength is about 12 cm, and thus the size of the short side of the electromagnetic wave propagation medium 1 may be 6 cm and the size of the long side may be 60 cm.

FIG. 3(*a*) is a perspective view illustrating enlarged portions of a first electromagnetic wave propagation medium 1A according to Embodiment 1.

The electromagnetic wave propagation medium 1A has a structure in which an electromagnetic wave is propagated through an electromagnetic wave propagation space interposed between a plate-shaped first conductive layer 2P and a plate-shaped second conductive layer 3, and a plurality of electromagnetic wave output interfaces 6*a* are, for example, slots which are opened in the first conductive layer 2P. In addition, the electromagnetic wave input interface 5 is disposed at a position close to one first end surface 7*a* of the electromagnetic wave propagation medium 1A, the electromagnetic wave output interfaces 6*a* are not provided between the electromagnetic wave input interface 5 and one first end surface 7*a*, and a plurality of electromagnetic wave output interfaces 6*a* are provided between the electromagnetic wave input interface 5 and the other first end surface 7*b*. Further, the first end surface 7*b* which is located at a position distant from the electromagnetic wave input interface 5 and reflects the electromagnetic wave in the traveling direction is short-circuited (FIG. 2(*a*)). The first end surface 7*a* and the two second end surfaces 8 and 8 located at positions close to the electromagnetic wave input interface 5 may be short-circuited or open-circuited.

An electromagnetic wave input from the electromagnetic wave input interface 5 is propagated through the electromagnetic wave propagation space and is reflected by one first end surface 7*b*. For this reason, a standing wave S1 is generated by the electromagnetic wave directed to the first end surface 7*b* and the electromagnetic wave reflected by the first end surface 7*b*. Since a phase is rotated by 180 degrees when the electromagnetic wave is reflected by the first end surface 7*b*, the standing wave is strengthened due to phases of the electromagnetic wave directed to the first end surface 7*b* and the electromagnetic wave reflected by the first end surface 7*b* conforming to each other at a distance of $\lambda/4+n\cdot\lambda/2$ from the first end surface 7*b*, and the standing wave is weakened due to phases of the electromagnetic wave directed to the first end surface 7*b* and the electromagnetic wave reflected by the first end surface 7*b* being inverse to each other at a distance of $n \cdot \lambda/2$ from the first end surface 7*b*. Here, λ indicates a wavelength of an electromagnetic wave propagated through the electromagnetic wave propagation space, and n is a natural number.

For example, in a case of using a frequency of 2.4 GHz band, if a dielectric constant of the electromagnetic wave propagation space is 1, a wavelength of an electromagnetic wave is about 12 cm, and, if a dielectric constant of the electromagnetic wave propagation space is 4, a wavelength of an electromagnetic wave is about 6 cm.

By the use of the standing wave S1, the more distant the electromagnetic wave output interface 6*a* is from the electromagnetic wave input interface 5, the closer to the distance of $\lambda/4+n \cdot \lambda/2$ from the first end surface 7*b* the electromagnetic wave output interface is installed. In other words, the more distant from the electromagnetic wave input interface 5 the electromagnetic wave output interface 6*a* is, the closer to the loop of the standing wave S1 the electromagnetic wave output interface 6*a* is located, and, the closer to the electromagnetic wave input interface 5 the electromagnetic wave output interface 6*a* is, the closer to the node of the standing wave S1 the electromagnetic wave output interface 6*a* is located. For example, an interval between the electromagnetic wave output interfaces 6*a* is set to be shorter than λ/2.

FIG. 3(*b*) is a perspective view illustrating enlarged main portions of a second electromagnetic wave propagation medium 1B according to Embodiment 1.

The electromagnetic wave propagation medium 1B has a structure in which an electromagnetic wave is propagated through an electromagnetic wave propagation space interposed between a mesh-shaped first conductive layer 2M and a plate-shaped second conductive layer 3, and a plurality of electromagnetic wave output interfaces 6*b* are, for example, marks added to the first conductive layer 2M and are realized in various methods such as printing or protrusions. In addition, the electromagnetic wave input interface 5 is disposed at a position close to one first end surface 7*a* of the electromagnetic wave propagation medium 1B, the electromagnetic wave output interfaces 6*b* are not provided between the electromagnetic wave input interface 5 and one first end surface 7*a*, and a plurality of electromagnetic wave output interfaces 6*b* are provided between the electromagnetic wave input interface 5 and the other first end surface 7*b*. Further, the first end surface 7*b* which is located at a position distant from the electromagnetic wave input interface 5 and reflects the electromagnetic wave in the traveling direction is short-circuited (FIG. 2(*a*)). The first end surface 7*a* and the two second end surfaces 8 and 8 located at positions close to the electromagnetic wave input interface 5 may be short-circuited or open-circuited. An interval of the conductor mesh of the first conductive layer 2M is constant.

The electromagnetic wave propagation medium 1B uses the mesh-shaped first conductive layer 2M instead of the plate-shaped first conductive layer 2P of the above-described electromagnetic wave propagation medium 1A. When the conductor (the first conductive layer 2M) of the upper surface has a mesh shape, since an electromagnetic wave is output from any position, much power is output at a location close to the electromagnetic wave input interface 5 in this state, and thus it is difficult for power to arrive at a distant location. Therefore, a plurality of electromagnetic wave output interfaces 6*b* are installed in the electromagnetic wave propagation medium 1B, and, for example, in a case where a communication device is installed in the electromagnetic wave propagation medium 1B, it can be ascertained which installation position of the communication device enables power to easily arrive even at a location distant from the electromagnetic wave input interface 5.

In the same manner as the above-described electromagnetic wave propagation medium 1A, the more distant from the electromagnetic wave input interface 5 the electromagnetic wave output interface 6*b* is, the closer to the loop of the standing wave 51 the electromagnetic wave output interface 6*b* is located, and, the closer to the electromagnetic wave input interface 5 the electromagnetic wave output interface 6*b* is, the closer to the node of the standing wave S1 the electromagnetic wave output interface 6*b* is located. For example, an interval between the electromagnetic wave output interfaces 6*b* is set to be shorter than λ/2.

FIG. 4(*a*) is a perspective view illustrating enlarged portions of a third electromagnetic wave propagation medium 1C according to Embodiment 1.

The electromagnetic wave propagation medium 1C has a structure in which an electromagnetic wave is propagated through an electromagnetic wave propagation space interposed between a plate-shaped first conductive layer 2P and a plate-shaped second conductive layer 3, and a plurality of electromagnetic wave output interfaces 6*a* are, for example, slots which are opened in the first conductive layer 2P. In addition, the electromagnetic wave input interface 5 is disposed at a position close to one first end surface 7*a* of the electromagnetic wave propagation medium 1C, the electromagnetic wave output interfaces 6*a* are not provided between the electromagnetic wave input interface 5 and one first end surface 7*a*, and a plurality of electromagnetic wave output interfaces 6*a* are provided between the electromagnetic wave input interface 5 and the other first end surface 7*b*. Further, the first end surface 7*b* which is located at a position distant from the electromagnetic wave input interface 5 and reflects the electromagnetic wave in the traveling direction is open-circuited (FIG. 2(*b*)). The first end surface 7*a* and the two second end surfaces 8 and 8 located at positions close to the electromagnetic wave input interface 5 may be short-circuited or open-circuited.

In the electromagnetic wave propagation medium 1C, the electromagnetic wave is reflected by the first end surface 7*b* and thus a standing wave S2 is generated. Since a phase is not rotated when the electromagnetic wave is reflected by the first end surface 7*b*, the standing wave is strengthened due to phases of the electromagnetic wave directed to the first end surface 7*b* and the electromagnetic wave reflected by the first end surface 7*b* conforming to each other at a distance of $n \cdot \lambda/2$ from the first end surface 7*b*, and the standing wave is weakened due to phases of the electromagnetic wave directed to the first end surface 7*b* and the electromagnetic wave reflected by the first end surface 7*b* being inverse to each other at a distance of $\lambda/4+n \cdot /2$ from the first end surface 7*b*.

By the use of the standing wave S2, the more distant the electromagnetic wave output interface 6*a* is from the electromagnetic wave input interface 5, the closer to the distance of $n \cdot \lambda/2$ from the first end surface 7*b* the electromagnetic wave output interface 6*a* is installed. In other words, the more distant from the electromagnetic wave input interface 5 the electromagnetic wave output interface 6*a* is, the closer to the loop of the standing wave S2 the electromagnetic wave output interface 6*a* is located, and, the closer to the electromagnetic wave input interface 5 the electromagnetic wave output interface 6*a* is, the closer to the node of the standing wave S2 the electromagnetic wave output interface 6*a* is located. For example, an interval between the electromagnetic wave output interfaces 6*a* is set to be shorter than λ/2.

FIG. 4(*b*) is a perspective view illustrating enlarged main portions of a fourth electromagnetic wave propagation medium 1D according to Embodiment 1.

The electromagnetic wave propagation medium 1D has a structure in which an electromagnetic wave is propagated through an electromagnetic wave propagation space interposed between a mesh-shaped first conductive layer 2M and a plate-shaped second conductive layer 3, and a plurality of electromagnetic wave output interfaces 6*b* are, for example, marks added to the first conductive layer 2M and are realized in various methods such as printing or protrusions. In addition, the electromagnetic wave input interface 5 is disposed at a position close to one first end surface 7*a* of the electromagnetic wave propagation medium 1D, the electromagnetic wave output interfaces 6*b* are not provided between the electromagnetic wave input interface 5 and one first end surface 7*a*, and a plurality of electromagnetic wave output interfaces 6*b* are provided between the electromagnetic wave input interface 5 and the other first end surface 7*b*. Further, the first end surface 7*b* which is located at a position distant from the electromagnetic wave input interface 5 and reflects the electromagnetic wave in the traveling direction is open-circuited (FIG. 2(*b*)). The first end surface 7*a* and the two second end surfaces 8 and 8 located at positions close to the electromagnetic wave input interface 5 may be short-circuited or open-circuited. An interval of the conductor mesh of the first conductive layer 2M is constant.

The electromagnetic wave propagation medium 1D uses the mesh-shaped first conductive layer 2M instead of the plate-shaped first conductive layer 2P of the above-described electromagnetic wave propagation medium 1C.

In the same manner as the above-described electromagnetic wave propagation medium 1C, the more distant from the electromagnetic wave input interface 5 the electromagnetic wave output interface 6*b* is, the closer to the loop of the standing wave S2 the electromagnetic wave output interface 6*b* is located, and, the closer to the electromagnetic wave input interface 5 the electromagnetic wave output interface 6*b* is, the closer to the node of the standing wave S2 the electromagnetic wave output interface 6*b* is located. For example, an interval between the electromagnetic wave output interfaces 6*b* is set to be shorter than $\lambda/2$.

FIG. 5(*a*) is a perspective view illustrating enlarged portions of a fifth electromagnetic wave propagation medium 1E according to Embodiment 1.

The electromagnetic wave propagation medium 1E has a structure in which an electromagnetic wave is propagated through an electromagnetic wave propagation space interposed between a plate-shaped first conductive layer 2P and a plate-shaped second conductive layer 3, and a plurality of electromagnetic wave output interfaces 6*a* are, for example, slots which are opened in the first conductive layer 2P. In addition, the electromagnetic wave input interface 5 is disposed at a position close to one first end surface 7*a* of the electromagnetic wave propagation medium 1E, the electromagnetic wave output interfaces 6*a* are not provided between the electromagnetic wave input interface 5 and one first end surface 7*a*, and a plurality of electromagnetic wave output interfaces 6*a* are provided between the electromagnetic wave input interface 5 and the other first end surface 7*b*. Further, the two second end surfaces 8 and 8 in the extending direction of the long side are short-circuited (FIG. 2(*a*)). The two first end surfaces 7*a* and 7*b* in the extending direction of the short side may be short-circuited or open-circuited.

The electromagnetic wave propagation medium 1E uses a standing wave S3 which is generated by the two second end surfaces 8 and 8. For example, a description will be made of a configuration of the electromagnetic wave propagation medium 1E in which the two second end surfaces 8 and 8 are short-circuited and a distance between the two second end surfaces 8 and 8 is $n\cdot\lambda/2$. An electromagnetic wave input from the electromagnetic wave input interface 5 is in a resonant state between the two second end surfaces 8 and 8, thereby generating the standing wave S3. By the use of the standing wave S3, the more distant the electromagnetic wave output interface 6*a* is from the electromagnetic wave input interface 5, the closer to the distance of $\lambda/4+n\cdot\lambda/2$ from one second end surface 8 the electromagnetic wave output interface 6*a* is installed. In other words, the more distant from the electromagnetic wave input interface 5 the electromagnetic wave output interface 6*a* is, the closer to the loop of the standing wave S3 the electromagnetic wave output interface 6*a* is located, and, the closer to the electromagnetic wave input interface 5 the electromagnetic wave output interface 6*a* is, the closer to the node of the standing wave S3 the electromagnetic wave output interface 6*a* is located.

In addition, by the use of the standing wave S1 generated by the electromagnetic wave directed to the first end surface 7*b* and the electromagnetic wave reflected by the first end surface 7*b*, in a case where the first end surface 7*b* is short-circuited, the electromagnetic wave output interface 6*a* is installed at a distance of $\lambda/4+n\cdot\lambda/2$ from the first end surface 7*b*. Alternatively, in a case where the first end surface 7*b* is open-circuited, the electromagnetic wave output interface 6*a* is installed at a distance of $n\cdot\lambda/2$ from the first end surface 7*b*.

In addition, the configuration of the electromagnetic wave propagation medium 1E and the configuration of the above-described electromagnetic wave propagation medium 1A or electromagnetic wave propagation medium 1C may be used together. In other words, the more distant the electromagnetic wave output interface 6*a* is from the electromagnetic wave input interface 5, the closer to the distance of $\lambda/4+n\cdot\lambda/2$ from the first end surface 7*b* which is short-circuited and one second end surface 8 which is short-circuited the electromagnetic wave output interface 6*a* is installed. Alternatively, the more distant the electromagnetic wave output interface 6*a* is from the electromagnetic wave input interface 5, the closer to the distance of $n\cdot\lambda/2$ from the first end surface 7*b* which is open-circuited and the distance of $\lambda/4+n\cdot\lambda/2$ from one second end surface 8 which is short-circuited the electromagnetic wave output interface is installed.

FIG. 5(*b*) is a perspective view illustrating enlarged portions of a sixth electromagnetic wave propagation medium 1F according to Embodiment 1.

The electromagnetic wave propagation medium 1F has a structure in which an electromagnetic wave is propagated through an electromagnetic wave propagation space interposed between a mesh-shaped first conductive layer 2M and a plate-shaped second conductive layer 3, and a plurality of electromagnetic wave output interfaces 6*b* are, for example, marks added to the first conductive layer 2M and are realized in various methods such as printing or protrusions. In addition, the electromagnetic wave input interface 5 is disposed at a position close to one first end surface 7*a* of the electromagnetic wave propagation medium 1F, the electromagnetic wave output interfaces 6*b* are not provided between the electromagnetic wave input interface 5 and one first end surface 7*a*, and a plurality of electromagnetic wave output interfaces 6*b* are provided between the electromagnetic wave input interface 5 and the other first end surface 7*b*. Further, the two second end surfaces 8 and 8 in the extending direction of the long side are short-circuited (FIG. 2(*a*)). The two first end surfaces 7*a* and 7*b* in the extending direction of the short side may be short-circuited or open-circuited. An interval of the conductor mesh of the first conductive layer 2M is constant.

The electromagnetic wave propagation medium 1F uses the mesh-shaped first conductive layer 2M instead of the plate-shaped first conductive layer 2P of the above-described electromagnetic wave propagation medium 1E.

In the same manner as the above-described electromagnetic wave propagation medium 1E, the more distant from the electromagnetic wave input interface 5 the electromagnetic wave output interface 6*b* is, the closer to the loop of the standing wave S3 the electromagnetic wave output interface 6*b* is located, and, the closer to the electromagnetic wave input interface 5 the electromagnetic wave output interface 6*b* is, the closer to the node of the standing wave S3 the electromagnetic wave output interface 6*b* is located.

In addition, in the same manner as the above-described electromagnetic wave propagation medium 1E, in a case where the first end surface 7*b* is short-circuited, the electromagnetic wave output interface 6*b* is installed at a distance of $\lambda/4+n\cdot\lambda/2$ from the first end surface 7*b*. Alternatively, in a case where the first end surface 7*b* is open-circuited, the electromagnetic wave output interface 6*b* is installed at a distance of $n\cdot\lambda/2$ from the first end surface 7*b*.

In addition, in the same manner as the above-described electromagnetic wave propagation medium 1E, the configuration of the electromagnetic wave propagation medium 1F and the configuration of the above-described electromagnetic wave propagation medium 1B or electromagnetic wave propagation medium 1D may be used together. In other words, the more distant the electromagnetic wave output interface 6*b* is from the electromagnetic wave input interface 5, the closer to the distance of $\lambda/4+n\cdot\lambda/2$ from the first end surface 7*b* which is short-circuited and one second end surface 8 which is short-circuited the electromagnetic wave output interface is installed. Alternatively, the more distant the electromagnetic wave output interface 6*b* is from the electromagnetic wave input interface 5, the closer to the distance of $n\cdot\lambda/2$ from the first end surface 7*b* which is open-circuited and the distance of $\lambda/4+n\cdot\lambda/2$ from one second end surface 8 which is short-circuited the electromagnetic wave output interface is installed.

FIGS. 6(*a*) and 6(*b*) are cross-sectional views illustrating enlarged main portions in the extending direction of the long side of the electromagnetic wave propagation medium according to Embodiment 1. FIG. 6(*a*) is a cross-sectional view illustrating the main portions corresponding to the electromagnetic wave propagation medium 1A taken along the line A-A' of FIG. 3(*a*) described above.

As shown in FIG. 6(*a*), in the electromagnetic wave propagation medium 1A, the electromagnetic wave output interfaces 6*a* are provided only in the conductor (the first conductive layer 2P) of the upper surface. However, as shown in FIG. 6(*b*), the electromagnetic wave output interfaces 6*a* may be provided in both the conductor (the first conductive layer 2P) of the upper surface and the conductor (the second conductive layer 3) of the lower surface. Although the electromagnetic wave propagation medium 1A has been described here, the electromagnetic wave output interfaces 6*a* may also be provided in both the conductor (the first conductive layer 2P) of the upper surface and the conductor (the second conductive layer 3) of the lower surface in the same manner for the electromagnetic wave propagation media 1C and 1E. In addition, in the electromagnetic wave propagation media 1B, 1D and 1F, the conductor (the second conductive layer 3) of the lower surface may have a mesh-shape, and the electromagnetic wave output interfaces 6*b* may be provided in both the conductor (the first conductive layer 2M) of the upper surface and the conductor (the second conductive layer 3) of the lower surface.

FIG. 7 is a perspective view illustrating main portions of a seventh electromagnetic wave propagation medium 1G which is a modified example of the first electromagnetic wave propagation medium 1A according to Embodiment 1, and FIG. 8 is a perspective view illustrating main portions of an eighth electromagnetic wave propagation medium 1H which is a modified example of the fifth electromagnetic wave propagation medium 1E according to Embodiment 1.

For example, in the above-described electromagnetic wave propagation medium 1A, the electromagnetic wave input interface 5 is provided around one end portion (the first end surface 7*a*) of the electromagnetic wave propagation medium 1A. However, as shown in FIG. 7, the electromagnetic wave input interface 5 may be provided around the center of the electromagnetic wave propagation medium 1G.

In addition, for example, in the above-described electromagnetic wave propagation medium 1E, the electromagnetic wave input interface 5 is provided around one end portion (the first end surface 7*a*) of the electromagnetic wave propagation medium 1A. However, as shown in FIG. 8, the electromagnetic wave input interface 5 may be provided around the center of the electromagnetic wave propagation medium 1H.

An electromagnetic wave input from the electromagnetic wave input interface 5 is propagated in a plurality of directions, and a plurality of electromagnetic wave output interfaces 6*a* may be installed in the respective propagation directions.

Although the modified examples of the first electromagnetic wave propagation medium 1A and the fifth electromagnetic wave propagation medium 1E have been described here, the same is applied to the other electromagnetic wave propagation media (the second electromagnetic wave propagation medium 1B, the third electromagnetic wave propagation medium 1C, the fourth electromagnetic wave propagation medium 1D, or the sixth electromagnetic wave propagation medium 1F).

FIG. 9 is a perspective view illustrating enlarged main portions of the first electromagnetic wave propagation medium 1A in which communication devices according to Embodiment 1 are installed.

The respective communication devices 10 are opposite to the electromagnetic wave input interface 5 and the electromagnetic wave output interfaces 6*a* of the electromagnetic wave propagation medium 1A, and the communication device 10 opposite to the electromagnetic wave input interface 5 communicates with the communication devices 10 opposite to the electromagnetic wave output interfaces 6*a*. At this time, electromagnetic wave interfaces 11 of the communication devices 10 are disposed at positions which are very suitable for input and output of electromagnetic waves with respect to the electromagnetic wave input interface 5 and the respective electromagnetic wave output interfaces 6*a* which are opposed to each other.

In addition, the communication device 10 preferably has almost the same size as an installation interval of the electromagnetic wave output interfaces 6*a* or a smaller size than the installation interval of the electromagnetic wave output interfaces 6*a*. That is, the size of the communication device 10 is smaller than $n\cdot\lambda/2$, and, preferably, smaller than $\lambda/2$. In other words, a wavelength of an electromagnetic wave which is propagated through an electromagnetic wave propagation space may be selected so as to be suitable for the size of the communication device 10.

As above, if the configuration of the electromagnetic wave propagation medium 1 (1A to 1H) according to Embodiment 1 is employed, the more distant the electromagnetic wave output interface 6 (6*a* and 6*b*) is from the electromagnetic wave input interface 5, the closer to the loop of the standing wave S1 or S2 generated by the reflected wave in the first end surface 7 (7*b*) of the electromagnetic wave propagation medium 1 (1A to 1H) or the standing wave S3 generated by the reflected wave in the second end surface 8 the electromagnetic wave output interface 6 (6*a* and 6*b*) is installed, and thereby it is possible to implement the electromagnetic wave propagation medium 1 (1A to 1H) which enables power to easily arrive even at the electromagnetic wave output interface 6 (6*a* and 6*b*) distant from the electromagnetic wave input interface 5.

Embodiment 2

Figure 10:
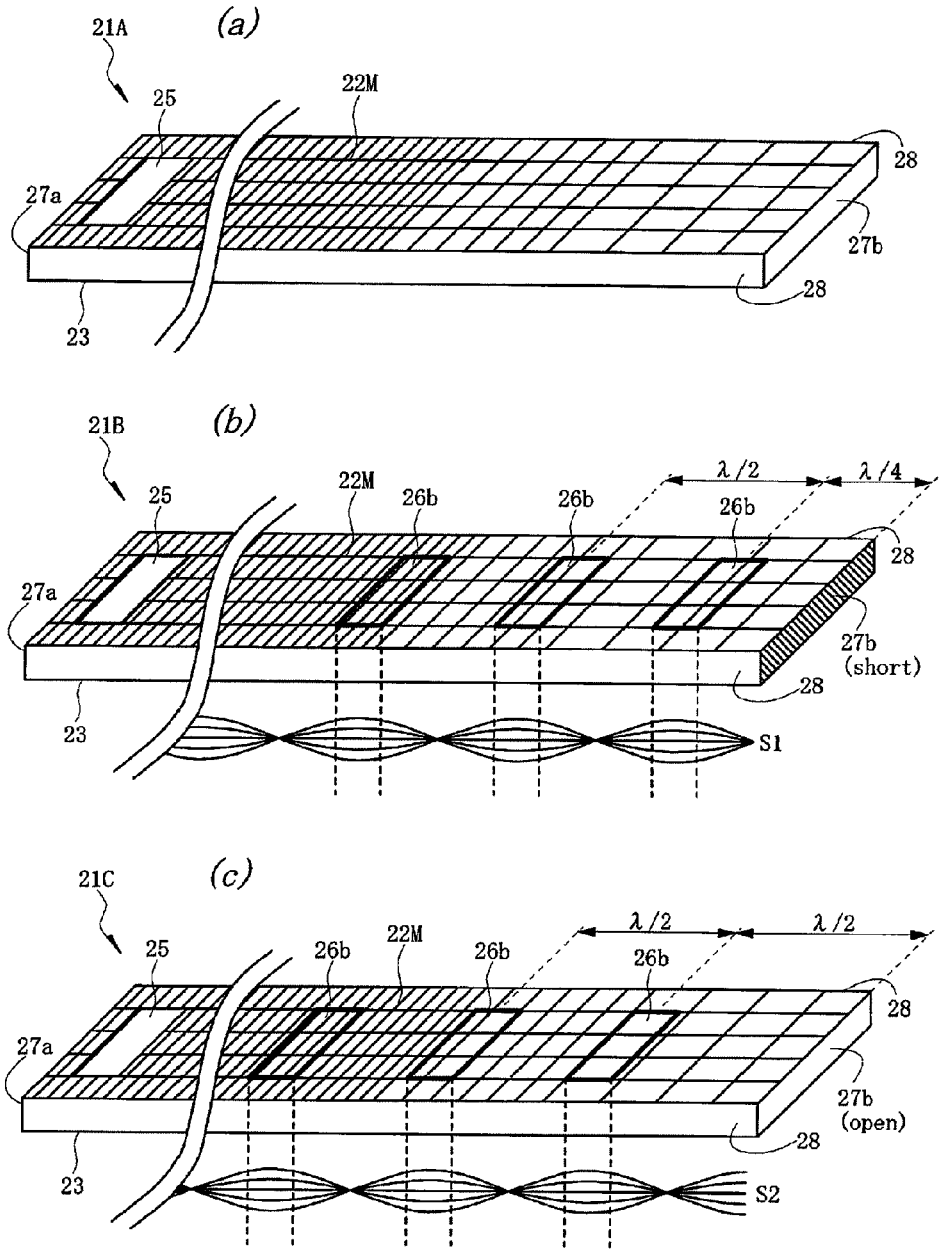
FIG. 10 is a perspective view illustrating enlarged main portions of an electromagnetic wave propagation medium according to Embodiment 2 of the invention, where (*a*), (*b*), and (*c*) are perspective views respectively illustrating first, second and third electromagnetic wave propagation media including first conductive layers with mesh shapes in which conductor mesh has a sparse or dense distribution.
Figure 11:
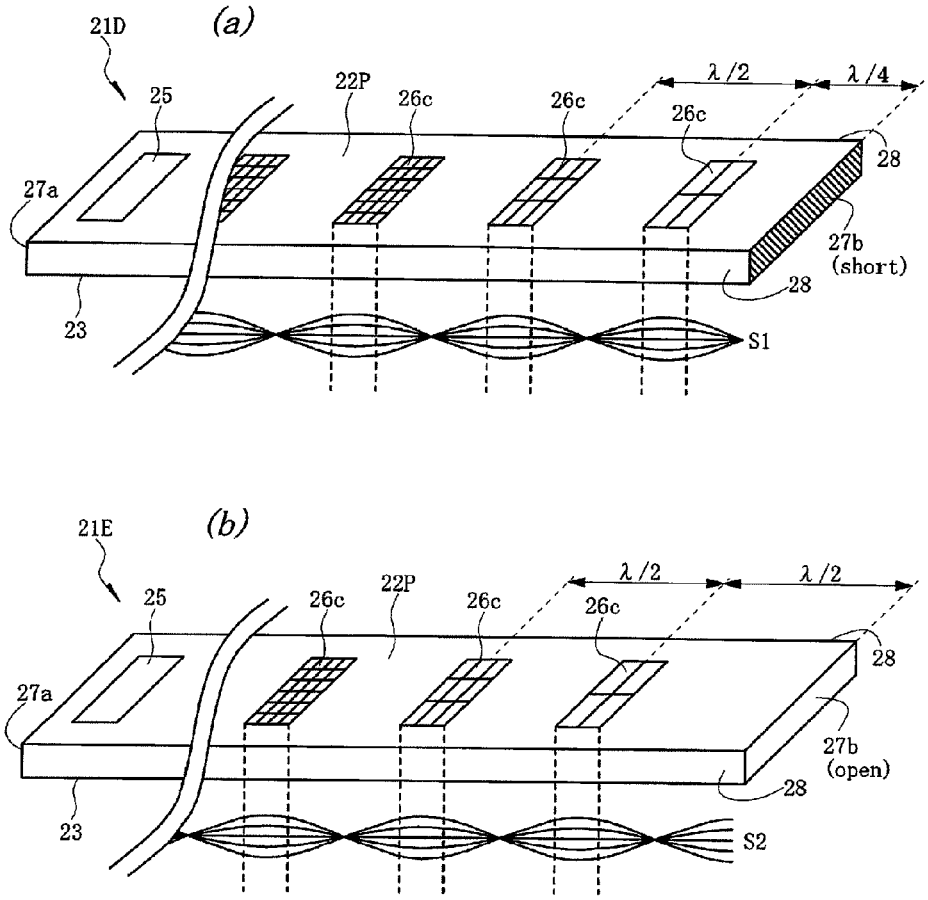
FIG. 11 is a perspective view illustrating enlarged main portions of the electromagnetic wave propagation medium according to Embodiment 2 of the invention, where (*a*) and (*b*) are perspective views respectively illustrating fourth and fifth electromagnetic wave propagation media including electromagnetic wave output interfaces with mesh shapes in which conductor mesh has a sparse or dense distribution.

An electromagnetic wave propagation medium according to Embodiment 2 will be described with reference to FIGS. 10 and 11. FIGS. 10 and 11 are perspective views illustrating enlarged main portions of an electromagnetic wave propagation medium.

In the electromagnetic wave propagation medium of Embodiment 2, an electromagnetic wave output interface has a mesh shape, the conductor mesh is adjusted so as to be sparse or dense, and thereby power can be made to easily arrive even at a location distant from an electromagnetic wave input interface.

FIG. 10(*a*) is a perspective view illustrating enlarged main portions of a first electromagnetic wave propagation medium 21A according to Embodiment 2.

The electromagnetic wave propagation medium 21A has a structure in which a planar electromagnetic wave propagation space is interposed between a mesh-shaped first conductive layer 22M and a plate-shaped second conductive layer 23 on upper and lower sides, and includes at least one electromagnetic wave input interface 25 provided in the first conductive layer 22M. In addition, the electromagnetic wave input interface 25 is provided at a position close to one first end surface 27*a*, and the electromagnetic wave output interfaces 26*a* are not provided between the electromagnetic wave input interface 25 and one first end surface 27*a*. Further, the electromagnetic wave propagation medium 21A has a strip shape with a long side in a traveling direction (a first direction) of a propagated electromagnetic wave and a short side in a direction (a second direction) perpendicular to the traveling direction of the electromagnetic wave.

In addition, in the same manner as the above-described electromagnetic wave propagation medium 1, two lateral surfaces (first end surfaces) 27*a* and 27*b* of the electromagnetic wave propagation space in the direction in which the short sides extend and two lateral surfaces (second end surfaces) 28 and 28 of the electromagnetic wave propagation space in a direction in which the long sides extend are short-circuited or open-circuited.

The first conductive layer 22M has a mesh shape, and the more distant from the electromagnetic wave input interface 25 is, the sparser the conductor mesh is. If the conductor mesh is sparse, there is an increase in an amount of electromagnetic waves which are output from inside to outside of the electromagnetic wave propagation medium 21A via the conductor mesh. The more distant the conductor mesh is from the electromagnetic wave input interface 25, the discretely sparser the conductor mesh may be, or the conductor mesh may become sparse by thinning conductors forming the conductor mesh, or the conductor mesh may become sparse by radially installing the conductor mesh with respect to the electromagnetic wave input interface 25.

FIG. 10(*b*) is a perspective view illustrating enlarged main portions of a second electromagnetic wave propagation medium 21B according to Embodiment 2.

The electromagnetic wave propagation medium 21B has a configuration in which the first end surface 27*b* which is distant from the electromagnetic wave input interface 25 and reflects an electromagnetic wave in the traveling direction of the electromagnetic wave is short-circuited (FIG. 2(*a*)), and a plurality of electromagnetic wave output interfaces 26*b* are added between the electromagnetic wave interface 25 and the first end surface 27*b* in the electromagnetic wave propagation medium 21A. The first end surface 27*a* and the two second end surfaces 28 and 28 close to the electromagnetic wave input interface 25 may be short-circuited or open-circuited. A plurality of electromagnetic wave output interfaces 26*b* are, for example, marks added to the first conductive layer 22M.

The electromagnetic wave output interfaces 26*b* are installed at a distance of $\lambda/4+n\cdot\lambda/2$ from the first end surface 27*b* by using a standing wave S1 generated by an electromagnetic wave directed to the first end surface 27*b* and an electromagnetic wave reflected by the first end surface 27*b*.

FIG. 10(*c*) is a perspective view illustrating enlarged main portions of a third electromagnetic wave propagation medium 21C according to Embodiment 2.

The electromagnetic wave propagation medium 21C has a configuration in which the first end surface 27*b* which is distant from the electromagnetic wave input interface 25 and reflects an electromagnetic wave in the traveling direction of the electromagnetic wave is open-circuited (FIG. 2(*b*)), and a plurality of electromagnetic wave output interfaces 26*b* are added between the electromagnetic wave interface 25 and the first end surface 27*b*, in the above-described electromagnetic wave propagation medium 21A. The first end surface 27*a* and the two second end surfaces 28 and 28 close to the electromagnetic wave input interface 25 may be short-circuited or open-circuited. A plurality of electromagnetic wave output interfaces 26*b* are, for example, marks added to the first conductive layer 22M.

The electromagnetic wave output interfaces 26*b* are installed at a distance of $n\cdot\lambda/2$ from the first end surface 27*b* by using a standing wave S2 generated by an electromagnetic wave directed to the first end surface 27*b* and an electromagnetic wave reflected by the first end surface 27*b*.

FIG. 11(*a*) is a perspective view illustrating enlarged main portions of a fourth electromagnetic wave propagation medium 21D according to Embodiment 2.

The electromagnetic wave propagation medium 21D has a structure in which a planar electromagnetic wave propagation space is interposed between a plate-shaped first conductive layer 22P and a plate-shaped second conductive layer 23 on upper and lower sides, and includes at least one electromagnetic wave input interface 25 and a plurality of electromagnetic wave output interfaces 26*c* provided in the first conductive layer 22M. In addition, the electromagnetic wave input interface 25 is disposed at a position close to one first end surface 27*a*, the electromagnetic wave output interfaces 26*c* are not provided between the electromagnetic wave input interface 25 and one first end surface 27*a*, and a plurality of electromagnetic wave output interfaces 26*c* are provided between the electromagnetic wave input interface 25 and the other first end surface 27*b*. Further, the electromagnetic wave propagation medium 21D has a strip shape with a long side in a traveling direction (a first direction) of a propagated electromagnetic wave and a short side in a direction (a second direction) perpendicular to the traveling direction of the electromagnetic wave.

A plurality of electromagnetic wave output interfaces 26*c* are, for example, slots which are opened in the first conductive layer 22P, and conductors are disposed in a mesh shape in opening portions thereof.

The more distant from the electromagnetic wave input interface 25 is, the sparser the conductor mesh of the electromagnetic wave output interfaces 26*c* is. If the conductor mesh of the electromagnetic wave output interfaces 26*c* is sparse, there is an increase in an amount of electromagnetic waves which are output from inside to outside of the electromagnetic wave propagation medium 21D via the electromagnetic wave output interfaces 26*c*. The more distant the conductor mesh of the electromagnetic wave output interfaces 26*c* is from the electromagnetic wave input interface 25, the discretely sparser the conductor mesh may be, or the conductor mesh may become sparse by thinning conductors forming the conductor mesh of the electromagnetic wave output interfaces 26*c*, or the conductor mesh may become sparse by radially installing the conductor mesh with respect to the electromagnetic wave input interface 25.

In addition, in the electromagnetic wave propagation medium 21D, the first end surface 27*b* which is distant from the electromagnetic wave input interface 25 and reflects an electromagnetic wave in the traveling direction of the electromagnetic wave is short-circuited (FIG. 2(*a*)). The first end surface 27*a* and the two second end surfaces 28 and 28 close to the electromagnetic wave input interface 25 may be short-circuited or open-circuited.

The electromagnetic wave output interfaces 26*c* are installed at a distance of $\lambda/4+n\cdot\lambda/2$ from the first end surface 27*b* by using a standing wave S1 generated by an electromagnetic wave directed to the first end surface 27*b* and an electromagnetic wave reflected by the first end surface 27*b*.

FIG. 11(*b*) is a perspective view illustrating enlarged main portions of a fifth electromagnetic wave propagation medium 21E according to Embodiment 2.

The electromagnetic wave propagation medium 21E has a configuration in which the first end surface 27*b* which is distant from the electromagnetic wave input interface 25 and reflects an electromagnetic wave in the traveling direction of the electromagnetic wave is open-circuited (FIG. 2(*b*)) in the above-described electromagnetic wave propagation medium 21D. The first end surface 27*a* and the two second end surfaces 28 and 28 close to the electromagnetic wave input interface 25 may be short-circuited or open-circuited.

The electromagnetic wave output interfaces 26*c* are installed at a distance of $n\cdot\lambda/2$ from the first end surface 27*b* by using a standing wave S2 generated by an electromagnetic wave directed to the first end surface 27*b* and an electromagnetic wave reflected by the first end surface 27*b*.

Further, Embodiment 1 described above may be combined with Embodiment 2, and, the more distant the electromagnetic wave output interface 26*b* or 26*c* from the electromagnetic wave input interface 25, the closer to the distance of $\lambda/4+n\cdot\lambda/2$ from the first end surface 27*b* or the second end surface 28 which is short-circuited the electromagnetic wave output interface may be installed, or the closer to the distance of $n\cdot\lambda/2$ from the first end surface 27*b* which is open-circuited the electromagnetic wave output interface may be installed.

In addition, although the electromagnetic wave output interfaces 26*b* and 26*c* are installed only in the first conductive layers 22M and 22P in Embodiment 2, the electromagnetic wave output interfaces 26*b* and 26*c* may also be installed in the second conductive layer 23 in the same manner as the first conductive layers 22M and 22P. Further, the electromagnetic wave input interface 25 may be installed at any position of the electromagnetic wave propagation media 21A to 21E.

As above, if the configurations of the electromagnetic wave propagation media 21A to 21E according to Embodiment 2 are employed, the more distant from the electromagnetic wave input interface 25 is, the sparser the conductor mesh is, and thereby it is possible to implement the electromagnetic wave propagation media 21A to 21E which enable power to easily arrive even at a location distant from the electromagnetic wave input interface 25. In addition, when the electromagnetic wave output interfaces 26*b* and 26*c* are installed at predetermined locations, it is possible to implement the electromagnetic wave propagation media 21A to 21E which enable power to easily arrive even at the electromagnetic wave output interfaces 26*b* and 26*c* distant from the electromagnetic wave input interface 25.

In addition, Embodiment 2 may be combined with Embodiment 1 described above, and thereby it is possible to implement the electromagnetic wave propagation media 21A to 21E which enable power to more easily arrive even at the electromagnetic wave output interfaces 26*b* and 26*c* distant from the electromagnetic wave input interface 25.

Furthermore, in the configuration of Embodiment 2, communication devices are installed so as to be opposite to the electromagnetic wave input interface 25 and the respective electromagnetic wave output interfaces 26*b* and 26*c*, and thereby the communication device opposite to the electromagnetic wave input interface 25 can communicate with the communication devices opposite to the respective electromagnetic wave output interfaces 26*b* and 26*c*. In this case, the communication device preferably has almost the same size as an installation interval of the electromagnetic wave output interfaces 26*b* and 26*c* or a smaller size than the installation interval of the electromagnetic wave output interfaces 26*b* and 26*c*. In other words, a wavelength of an electromagnetic wave which is propagated through an electromagnetic wave propagation space may be selected so as to be suitable for the size of the communication device.

Embodiment 3

Figure 12:
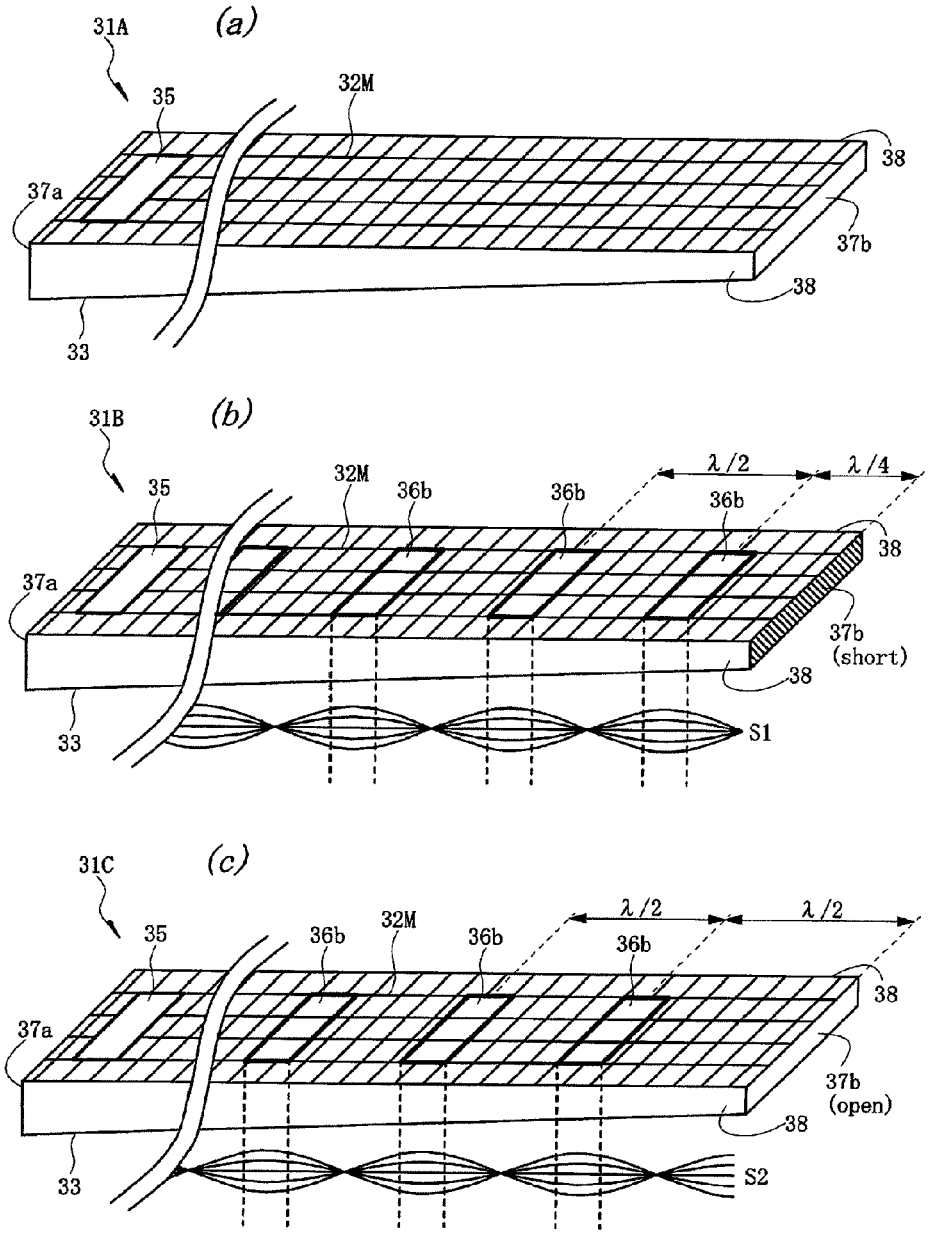
FIG. 12 is a perspective view illustrating enlarged main portions of an electromagnetic wave propagation medium in which a distance between a front surface of a first conductive layer and a rear surface of a second conductive layer is inclined according to Embodiment 3 of the invention, where (*a*), (*b*), and (*c*) are perspective views respectively illustrating first, second and third electromagnetic wave propagation media including the first conductive layers with a mesh shape.
Figure 13:
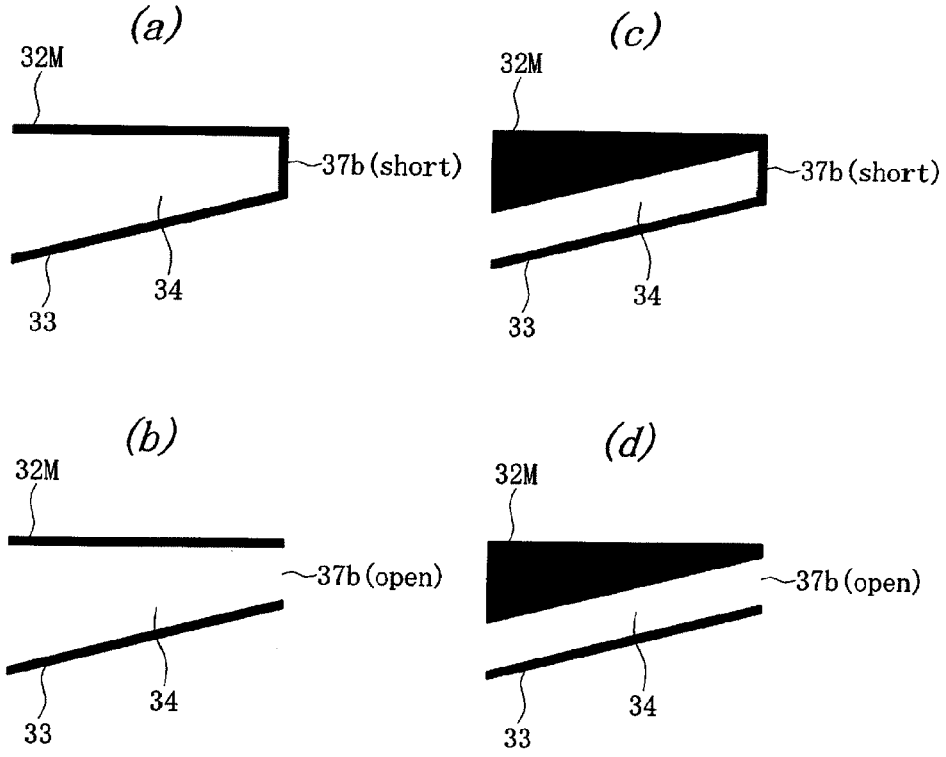
FIG. 13 is a cross-sectional view illustrating enlarged end portions of the electromagnetic wave propagation medium in which a distance between the front surface of the first conductive layer and the rear surface of the second conductive layer is inclined according to Embodiment 3 of the invention, where (*a*) and (*b*) are cross-sectional views illustrating main portions of the electromagnetic wave propagation media in which the thickness of an electromagnetic wave propagation space is inclined, and (*c*) and (*d*) are cross-sectional views illustrating main portions of the electromagnetic wave propagation media in which the thickness of the first conductive layer is inclined.
Figure 14:
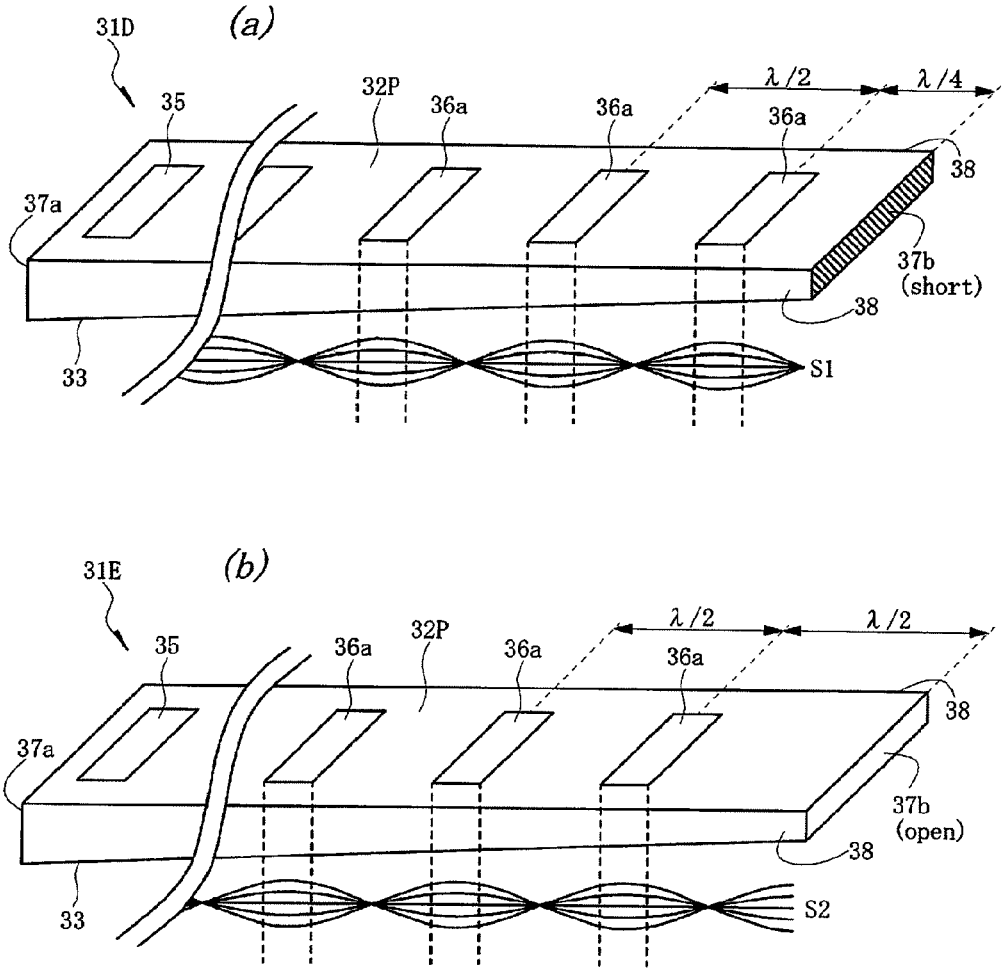
FIG. 14 is a perspective view illustrating enlarged main portions of the electromagnetic wave propagation medium in which a distance between the front surface of the first conductive layer and the rear surface of the second conductive layer is inclined according to Embodiment 3 of the invention, where (*a*) and (*b*) are perspective views respectively illustrating fourth and fifth electromagnetic wave propagation media including the first conductive layers with a plate shape.
Figure 15:
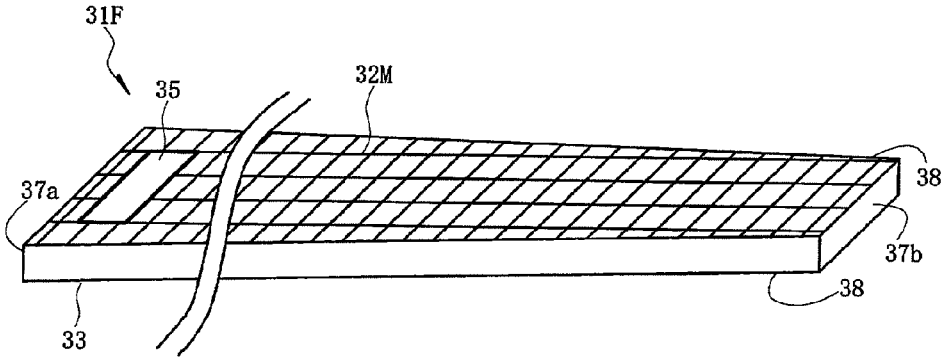
FIG. 15 is a perspective view illustrating enlarged main portions of a sixth electromagnetic wave propagation medium including a first conductive layer with a mesh shape in which a distance between two second end surfaces with the electromagnetic wave propagation space interposed therebetween is inclined according to Embodiment 3 of the invention.

An electromagnetic wave propagation medium according to Embodiment 3 will be described with reference to FIGS. 12 to 15. FIGS. 12, 14 and 15 are perspective views illustrating enlarged main portions of an electromagnetic wave propagation medium, and FIG. 13 is a cross-sectional view illustrating enlarged main portions of the electromagnetic wave propagation medium.

In the electromagnetic wave propagation medium according to Embodiment 3, a distance between a front surface (a surface on an opposite side to a surface which comes into contact with an electromagnetic wave propagation space) of a first conductive layer and a rear surface (a surface which comes into contact with the electromagnetic wave propagation space) of a second conductive layer may be adjusted, and thereby power is made to easily arrive even at a location distant from an electromagnetic wave input interface.

FIG. 12(*a*) is a perspective view illustrating enlarged main portions of a first electromagnetic wave propagation medium 31A according to Embodiment 3.

The electromagnetic wave propagation medium 31A has a structure in which a planar electromagnetic wave propagation space is interposed between a mesh-shaped first conductive layer 32M and a plate-shaped second conductive layer 33 on upper and lower sides, and includes at least one electromagnetic wave input interface 35 provided in the first conductive layer 32M. In addition, the electromagnetic wave input interface 35 is provided at a position close to one first end surface 37*a*, and the electromagnetic wave output interfaces 36*a* are not provided between the electromagnetic wave input interface 35 and one first end surface 37*a*. Further, the electromagnetic wave propagation medium 31A has a strip shape with a long side in a traveling direction (a first direction) of a propagated electromagnetic wave and a short side in a direction (a second direction) perpendicular to the traveling direction of the electromagnetic wave.

In addition, in the same manner as the above-described electromagnetic wave propagation medium 1, two lateral surfaces (first end surfaces) 37*a* and 37*b* of the electromagnetic wave propagation space in the direction in which the short sides extend and two lateral surfaces (second end surfaces) 38 and 38 of the electromagnetic wave propagation space in a direction in which the long sides extend are short-circuited or open-circuited.

In addition, a distance between the front surface (the surface on an opposite side to the surface which comes into contact with the electromagnetic wave propagation space) of the first conductive layer 32M and the rear surface (the surface which comes into contact with the electromagnetic wave propagation space) of the second conductive layer 33 in the first end surface 37*a* close to the electromagnetic wave input interface 35 is longer than a distance between the front surface (the surface on an opposite side to the surface which comes into contact with the electromagnetic wave propagation space) of the first conductive layer 32M and the rear surface (the surface which comes into contact with the electromagnetic wave propagation space) of the second conductive layer 33 in the first end surface 37*a* distant from the electromagnetic wave input interface 35, and, the more distant from the electromagnetic wave input interface 35 it is, the shorter the distance between the front surface (the surface on an opposite side to the surface which comes into contact with the electromagnetic wave propagation space) of the first conductive layer 32M and the rear surface (the surface which comes into contact with the electromagnetic wave propagation space) of the second conductive layer 33 becomes.

FIGS. 13(*a*) to 13(*d*) are cross-sectional views illustrating enlarged end portions of electromagnetic wave propagation media distant from the electromagnetic wave input interface. The electromagnetic wave propagation medium includes a conductor (the first conductive layer 32M) of the upper surface, a conductor (the second conductive layer 33) of the lower surface, and an electromagnetic wave propagation space 34. The conductor (the first conductive layer 32M) of the upper surface is formed in a mesh shape.

In the electromagnetic wave propagation media shown in FIGS. 13(*a*) and 13(*b*), the more distant from the electromagnetic wave input interface it is, the thinner the electromagnetic wave propagation space 34 it is, and, in the electromagnetic wave propagation media shown in FIGS. 13(*c*) and 13(*d*), the more distant from the electromagnetic wave input interface it is, the thinner the first conductive layer 32M it is. In addition, in the electromagnetic wave propagation media shown in FIGS. 13(*a*) and 13(*c*), the first end surface 37*b* distant from the electromagnetic wave input interface is short-circuited, and, in the electromagnetic wave propagation media shown in FIGS. 13(*b*) and 13(*d*), the first end surface 37*b* distant from the electromagnetic wave input interface is open-circuited.

In this configuration, assuming a case where an electromagnetic wave reception device is installed in the front surface (the surface on an opposite side to the surface which comes into contact with the electromagnetic wave propagation space) of the first conductive layer 32M, the thickness of the first conductive layer 32M or the thickness of the electromagnetic wave propagation space 34 which influences a propagation amount of electromagnetic waves which is propagated through the electromagnetic wave propagation space 34 will be described in the following. In addition, generally, an electromagnetic wave reception device can strongly act on the electromagnetic wave propagation space 34 which is disposed closer thereto, and receive an electromagnetic wave.

In the configurations of the electromagnetic wave propagation media shown in FIGS. 13(*a*) and 13(*b*), the electromagnetic wave reception device strongly acts on an electromagnetic wave which is propagated through the upper part of the electromagnetic wave propagation space 34 and receives the electromagnetic wave. For this reason, an electromagnetic waves propagated through the lower part of the electromagnetic wave propagation space 34 are not greatly received. In other words, in a case where the electromagnetic wave propagation space 34 is thick, a proportion of electromagnetic waves received by the electromagnetic reception device is small among electromagnetic waves propagated through the electromagnetic wave propagation space 34. Therefore, if the thickness of the first conductive layer 32M is constant, the electromagnetic wave propagation space 34 close to the electromagnetic wave input interface is made to be thick (the distance between the front surface (the surface on an opposite side to the surface which comes into contact with the electromagnetic wave propagation space) of the first conductive layer 32M and the rear surface (the surface which comes into contact with the electromagnetic wave propagation space) of the second conductive layer 33 is made to be long), and thereby a larger amount of electromagnetic waves are made to be propagated to a location distant from the electromagnetic wave input interface.

In addition, in the configurations shown in FIGS. 13(*c*) and 13(*d*), it is difficult for the electromagnetic wave reception device to receive an electromagnetic wave propagated through the electromagnetic wave propagation space 34 as the first conductive layer 32M becomes thicker. Therefore, if the thickness of the electromagnetic wave propagation space 34 is constant, the first conductive layer 32M close to the electromagnetic wave input interface is made to be thick (the distance between the front surface (the surface on an opposite side to the surface which comes into contact with the electromagnetic wave propagation space) of the first conductive layer 32M and the rear surface (the surface which comes into contact with the electromagnetic wave propagation space) of the second conductive layer 33 is made to be long, and thereby a larger amount of electromagnetic waves are made to be propagated to a location distant from the electromagnetic wave input interface.

A structure of the electromagnetic wave propagation medium is not limited to the structures shown in FIGS. 13(*a*) to 13(*d*), and, in a case where a protective layer is installed in the front surface (the surface on an opposite side to the surface which comes into contact with the electromagnetic wave propagation space) of the first conductive layer 32M, the same effect can be achieved by adjusting the thickness of the protective layer. In addition, the thickness of the second conductive layer 33 may be adjusted such that a cross-sectional view of the electromagnetic wave propagation medium is rectangular.

FIG. 12(*b*) is a perspective view illustrating enlarged main portions of a second electromagnetic wave propagation medium 31B according to Embodiment 3.

The electromagnetic wave propagation medium 31B has a configuration in which the first end surface 37*b* which is distant from the electromagnetic wave input interface 35 and reflects an electromagnetic wave in the traveling direction of the electromagnetic wave is short-circuited (FIGS. 13(*a*) and 13(*c*)), and a plurality of electromagnetic wave output interfaces 36*b* are added between the electromagnetic wave input interface 35 and the first end surface 37*b* in the electromagnetic wave propagation medium 31A. The first end surface 37*a* and the two second end surfaces 38 and 38 close to the electromagnetic wave input interface 35 may be short-circuited or open-circuited. A plurality of electromagnetic wave output interfaces 36*b* are, for example, marks added to the first conductive layer 32M.

The electromagnetic wave output interfaces 36*b* are installed at a distance of $\lambda/4+n\cdot\lambda/2$ from the first end surface 37*b* by using a standing wave S1 generated by an electromagnetic wave directed to the first end surface 37*b* and an electromagnetic wave reflected by the first end surface 37*b*.

FIG. 12(*c*) is a perspective view illustrating enlarged main portions of a third electromagnetic wave propagation medium 31C according to Embodiment 3.

The electromagnetic wave propagation medium 31C has a configuration in which the first end surface 37*b* which is distant from the electromagnetic wave input interface 35 and reflects an electromagnetic wave in the traveling direction of the electromagnetic wave is open-circuited (FIGS. 13(*b*) and 13(*d*)), and a plurality of electromagnetic wave output interfaces 36*b* are added between the electromagnetic wave input interface 35 and the first end surface 37*b*, in the above-described electromagnetic wave propagation medium 31A. The first end surface 37*a* and the two second end surfaces 38 and 38 close to the electromagnetic wave input interface 35 may be short-circuited or open-circuited. A plurality of electromagnetic wave output interfaces 36*b* are, for example, marks added to the first conductive layer 32M.

The electromagnetic wave output interfaces 36*b* are installed at a distance of $n\cdot\lambda/2$ from the first end surface 37*b* by using a standing wave S2 generated by an electromagnetic wave directed to the first end surface 37*b* and an electromagnetic wave reflected by the first end surface 37*b*.

FIG. 14(*a*) is a perspective view illustrating enlarged main portions of a fourth electromagnetic wave propagation medium 31D according to Embodiment 3.

The electromagnetic wave propagation medium 31D has a structure in which a planar electromagnetic wave propagation space is interposed between a plate-shaped first conductive layer 32P and a plate-shaped second conductive layer 33 on upper and lower sides, and includes at least one electromagnetic wave input interface 35 and a plurality of electromagnetic wave output interfaces 36*a* provided in the first conductive layer 32M. The electromagnetic wave output interfaces 36*a* are, for example, slots which are opened in the first conductive layer 32P. In addition, the electromagnetic wave input interface 35 is disposed at a position close to one first end surface 37*a*, the electromagnetic wave output interfaces 36*a* are not provided between the electromagnetic wave input interface 35 and one first end surface 37*a*, and a plurality of electromagnetic wave output interfaces 36*a* are provided between the electromagnetic wave input interface 35 and the other first end surface 37*b*. Further, the electromagnetic wave propagation medium 31D has a strip shape with a long side in a traveling direction (a first direction) of a propagated electromagnetic wave and a short side in a direction (a second direction) perpendicular to the traveling direction of the electromagnetic wave.

In addition, a distance between the front surface (the surface on an opposite side to the surface which comes into contact with the electromagnetic wave propagation space) of the first conductive layer 32P and the rear surface (the surface which comes into contact with the electromagnetic wave propagation space) of the second conductive layer 33 in the first end surface 37*a* close to the electromagnetic wave input interface 35 is longer than a distance between the front surface (the surface on an opposite side to the surface which comes into contact with the electromagnetic wave propagation space) of the first conductive layer 32P and the rear surface (the surface which comes into contact with the electromagnetic wave propagation space) of the second conductive layer 33 in the first end surface 37*b* distant from the electromagnetic wave input interface 35, and, the more distant from the electromagnetic wave input interface 35 it is, the shorter the distance between the front surface (the surface on an opposite side to the surface which comes into contact with the electromagnetic wave propagation space) of the first conductive layer 32P and the rear surface (the surface on an opposite side to the surface which comes into contact with the electromagnetic wave propagation space) of the second conductive layer 33 is.

In addition, in the electromagnetic wave propagation medium 31D, the first end surface 37*b* which is distant from the electromagnetic wave input interface 35 and reflects an electromagnetic wave in the traveling direction of the electromagnetic wave is short-circuited (FIGS. 13(*a*) and 13(*c*)). The first end surface 37*a* and the two second end surfaces 38 and 38 close to the electromagnetic wave input interface 35 may be short-circuited or open-circuited.

The electromagnetic wave output interfaces 36*a* are installed at a distance of $\lambda/4+n\cdot\lambda/2$ from the first end surface 37*b* by using a standing wave S1 generated by an electromagnetic wave directed to the first end surface 37*b* and an electromagnetic wave reflected by the first end surface 37*b*.

FIG. 14(*b*) is a perspective view illustrating enlarged main portions of a fifth electromagnetic wave propagation medium 31E according to Embodiment 3.

The electromagnetic wave propagation medium 31E has a configuration in which the first end surface 37*b* which is distant from the electromagnetic wave input interface 35 and reflects an electromagnetic wave in the traveling direction of the electromagnetic wave is open-circuited (FIGS. 13(*b*) and 13(*d*)) in the above-described electromagnetic wave propagation medium 31D. The first end surface 37*a* and the two second end surfaces 38 and 38 close to the electromagnetic wave input interface 35 may be short-circuited or open-circuited.

The electromagnetic wave output interfaces 36*a* are installed at a distance of $n\cdot\lambda/2$ from the first end surface 37*b* by using a standing wave S2 generated by an electromagnetic wave directed to the first end surface 37*b* and an electromagnetic wave reflected by the first end surface 37*b*.

FIG. 15 is a perspective view illustrating enlarged main portions of a sixth electromagnetic wave propagation medium 31F according to Embodiment 3.

The electromagnetic wave propagation medium 31F has a structure in which an electromagnetic wave is propagated through an electromagnetic wave propagation space interposed between a mesh-shaped first conductive layer 32M and a plate-shaped second conductive layer 33. The two first end surfaces 37*a* and 37*b*, and the two second end surfaces 38 and 38 may be short-circuited or open-circuited. In addition, the electromagnetic wave input interface 35 is provided at a position close to one first end surface 37*a* of the electromagnetic wave propagation medium 31F, and the electromagnetic wave output interfaces 36*a* are not provided between the electromagnetic wave input interface 35 and one first end surface 37*a*. Further, the more distant from the electromagnetic wave input interface 35 it is, the shorter the distance between the two second end surfaces 38 and 38 with the electromagnetic wave propagation space interposed therebetween is.

As the distance between the two second end surfaces 38 and 38 with the electromagnetic wave propagation space interposed therebetween becomes longer, electromagnetic waves which are radiated from the electromagnetic wave output interfaces 36*b* becomes smaller than electromagnetic waves which are not radiated and propagated through the electromagnetic wave propagation space. Therefore, in the electromagnetic wave propagation medium 31F, the distance between the two second end surfaces 38 and 38 with the electromagnetic wave propagation space interposed therebetween is shortened at a location distant from the electromagnetic wave input interface 35, and thereby a proportion of electromagnetic waves received by an electromagnetic wave reception device increases among electromagnetic waves propagating through the electromagnetic wave propagation space.

Further, Embodiment 1 described above may be combined with Embodiment 3, and, the more distant the electromagnetic wave output interface 36*a* or 36*b* is from the electromagnetic wave input interface 35, the closer to the distance of $\lambda/4+n\cdot\lambda/2$ from the first end surface 37*b* or one second end surface 38 which is short-circuited the electromagnetic wave output interface may be installed, or the closer to the distance of $n\cdot\lambda/2$ from the first end surface 37*b* which is open-circuited the electromagnetic wave output interface may be installed.

In addition, Embodiment 2 described above may be combined with Embodiment 3, and, the more distant a location is from the electromagnetic wave input interface 35, the sparser the conductor mesh of the first conductive layer 32M of the electromagnetic wave propagation media 31A to 31C and 31F may be. Alternatively, conductor mesh may be provided in the opening portions of the electromagnetic wave output interfaces 36*a* of the electromagnetic wave propagation media 31D and 31E, and the more distant the opening portions of the electromagnetic wave output interfaces 36*a* are from the electromagnetic wave input interface 35, the sparser the conductor mesh may be.

In addition, although the electromagnetic wave output interfaces 36*a* and 36*b* are installed only in the first conductive layers 32M and 32P in Embodiment 3, the electromagnetic wave output interfaces 36*a* and 36*b* may also be installed in the second conductive layer 33 in the same manner as the first conductive layers 32M and 32P. Further, the electromagnetic wave input interface 35 may be installed at any position of the electromagnetic wave propagation media 31A to 31F.

As above, if the configurations of the electromagnetic wave propagation media 31A to 31F according to Embodiment 3 are employed, the more distant from the electromagnetic wave input interface 35 the location is, the shorter the distance between the front surface (the surface on an opposite side to the surface which comes into contact with the electromagnetic wave propagation space) of the first conductive layer 32M or 32P in which a communication device is provided and the rear surface (the surface which comes into contact with the electromagnetic wave propagation space) of the second conductive layer 33 in the electromagnetic wave propagation media 31A to 31E is, and, the shorter the distance between the two second end surfaces 38 and 38 with the electromagnetic wave propagation space interposed therebetween is in the electromagnetic wave propagation medium 31F, and thereby it is possible to implement the electromagnetic wave propagation media 31A to 31F which enable power to easily arrive even at a location distant from the electromagnetic wave input interface 35. In addition, when the electromagnetic wave output interfaces 36*a* and 36*b* are installed at predetermined locations, it is possible to implement the electromagnetic wave propagation media 31A to 31F which enable power to easily arrive even at the electromagnetic wave output interfaces 36*a* and 36*b* distant from the electromagnetic wave input interface 35.

In addition, Embodiment 3 may be combined with Embodiment 1 described above, and thereby it is possible to implement the electromagnetic wave propagation media 31A to 31F which enable power to more easily arrive even at the electromagnetic wave output interfaces 36*b* and 36*c* distant from the electromagnetic wave input interface 35.

Furthermore, in the configuration of Embodiment 3, communication devices are installed so as to be opposite to the electromagnetic wave input interface 35 and the respective electromagnetic wave output interfaces 36*a* and 36*b*, and thereby the communication device opposite to the electromagnetic wave input interface 35 can communicate with the communication devices opposite to the respective electromagnetic wave output interfaces 36*a* and 36*b*. In this case, the communication device preferably has almost the same size as an installation interval of the electromagnetic wave output interfaces 36*a* or 36*b* or a smaller size than the installation interval of the electromagnetic wave output interfaces 36*a* and 36*b*. In other words, a wavelength of an electromagnetic wave which is propagated through an electromagnetic wave propagation space may be selected so as to be suitable for the size of the communication device.

Embodiment 4

An electromagnetic wave propagation medium according to Embodiment 4 will be described with reference to FIGS. 16 to 19. FIGS. 16 to 19 are perspective views illustrating enlarged main portions of an electromagnetic wave propagation medium.

In the electromagnetic wave propagation medium according to Embodiment 4, a shape of a first end surface which reflects an electromagnetic wave in a traveling direction of the electromagnetic wave is adjusted so as to reduce influence of a standing wave. In Embodiment 4, a description will be made of a shape in which the first end surface which reflects an electromagnetic wave is given a step difference and is divided into two.

Figure 16:
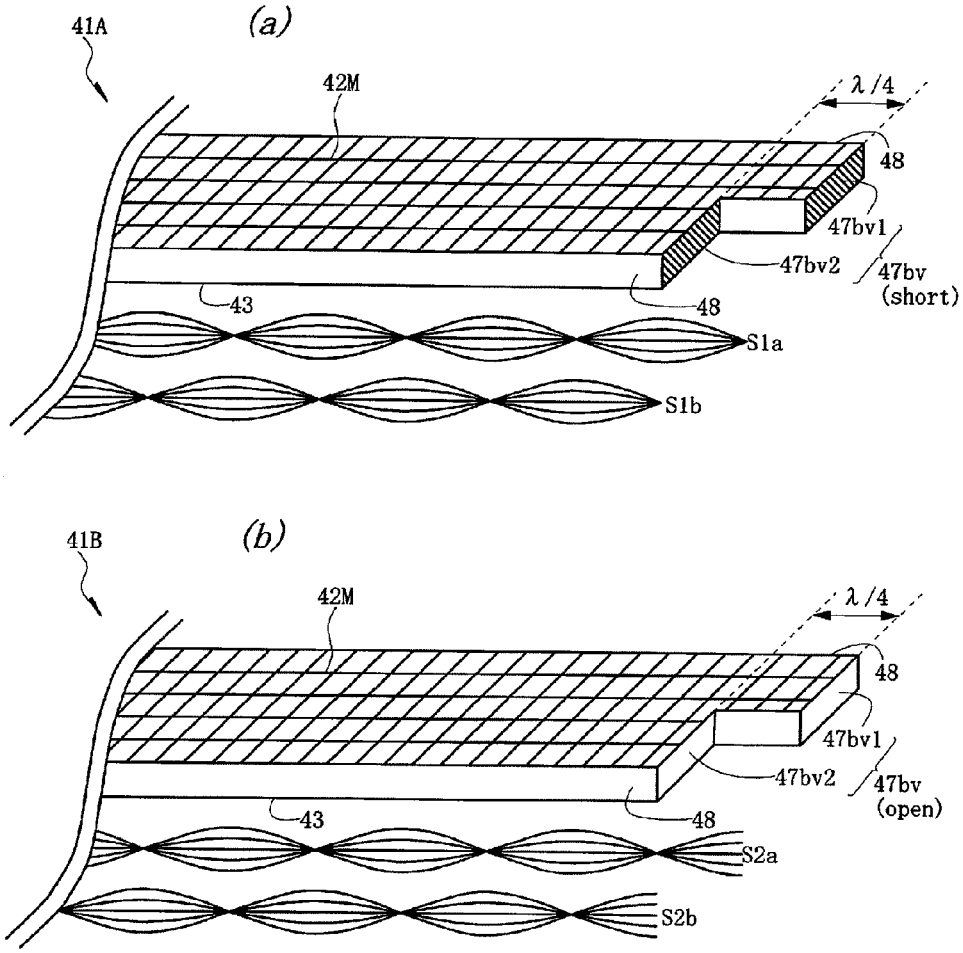
FIG. 16 is a perspective view illustrating enlarged main portions of an electromagnetic wave propagation medium in which a first end surface has a step difference according to Embodiment 4 of the invention, where (*a*) and (*b*) are perspective views respectively illustrating first and second electromagnetic wave propagation media including first conductive layers with a mesh shape.

FIG. 16(*a*) is a perspective view illustrating enlarged main portions of a first electromagnetic wave propagation medium 41A according to Embodiment 4.

The electromagnetic wave propagation medium 41A has a structure in which a planar electromagnetic wave propagation space is interposed between a mesh-shaped first conductive layer 42M and a plate-shaped second conductive layer 43 on upper and lower sides, and includes at least one electromagnetic wave input interface 35 provided in the first conductive layer 42M. Further, the electromagnetic wave propagation medium 41A has a strip shape with a long side in a traveling direction (a first direction) of a propagated electromagnetic wave and a short side in a direction (a second direction) perpendicular to the traveling direction of the electromagnetic wave.

Further, the electromagnetic wave propagation medium 41A has two surfaces (first end surfaces 47*bv*1 and 47*bv*2) with different distances from the electromagnetic wave input interface, and one first end surface 47*bv* which reflects an electromagnetic wave in a traveling direction of the electromagnetic wave is divided into two surfaces (first end surfaces 47*bv*1 and 47*bv*2) such that a step difference occurs in an extending direction of the short side. One second end surface 48 along a long side of the electromagnetic wave propagation medium 41A is formed so as to be shorter than the other second end surface 48.

In the electromagnetic wave propagation medium 41A, the first end surface 47*bv*1 and the first end surface 47*bv*2 are short-circuited. In addition, in the first end surface 47*bv*1 and the first end surface 47*bv*2, there is a difference of $\lambda/4+n\cdot\lambda/2$ ((1, 2, . . . , and $m-1)\cdot\lambda/(2\cdot m)+n\cdot\lambda/2$; m=2) at a distance in a direction in which the long side of the electromagnetic wave propagation medium 41A extends. When expressed in a phase, there is a difference of $\pi/2+n\cdot\pi$ ((1, 2, . . . , and $m-1)\cdot\pi/m+n\cdot\pi$; m=2). $\pi$ is the circular constant. In addition, electromagnetic waves which are propagated toward the first end surface 47*bv*1 and the first end surface 47*bv*2 respectively overlap electromagnetic waves reflected by the first end surface 47*bv*1 and the first end surface 47*bv*2 so as to generate a standing wave S1*a* and a standing wave S1*b*. A distance between the first end surface 47*bv*1 and the first end surface 47*bv*2 has a phase difference of 90 degrees with respect to a propagated electromagnetic wave, and thus the standing wave S1*a* and the standing wave S1*b* also have a phase difference of 90 degrees. For this reason, in the standing wave S1*a* and the standing wave S1*b*, the loops and the nodes of each other appear at the same position and thus cancel out each other. Therefore, it is possible to reduce influence of the standing waves in the electromagnetic wave propagation space.

FIG. 16(*b*) is a perspective view illustrating enlarged main portions of a second electromagnetic wave propagation medium 41B according to Embodiment 4.

The electromagnetic wave propagation medium 41B has a configuration in which the first end surface 47*bv*1 and the first end surface 47*bv*2 are open-circuited in the above-described electromagnetic wave propagation medium 41A. In the first end surface 47*bv*1 and the first end surface 47*bv*2, there is a difference of $\lambda/4+n\cdot\lambda/2$ at a distance in a direction in which the long side of the electromagnetic wave propagation medium 41B extends. For this reason, electromagnetic waves are reflected by both the first end surface 47*bv*1 and the first end surface 47*bv*2 so as to generate a standing wave S2*a* and a standing wave S2*b*, and the standing wave S2*a* and the standing wave S2*b* have a phase difference of 90 degrees, thereby canceling out the loops and the nodes of each other. Therefore, it is possible to reduce influence of the standing waves in the electromagnetic wave propagation space.

Figure 17:
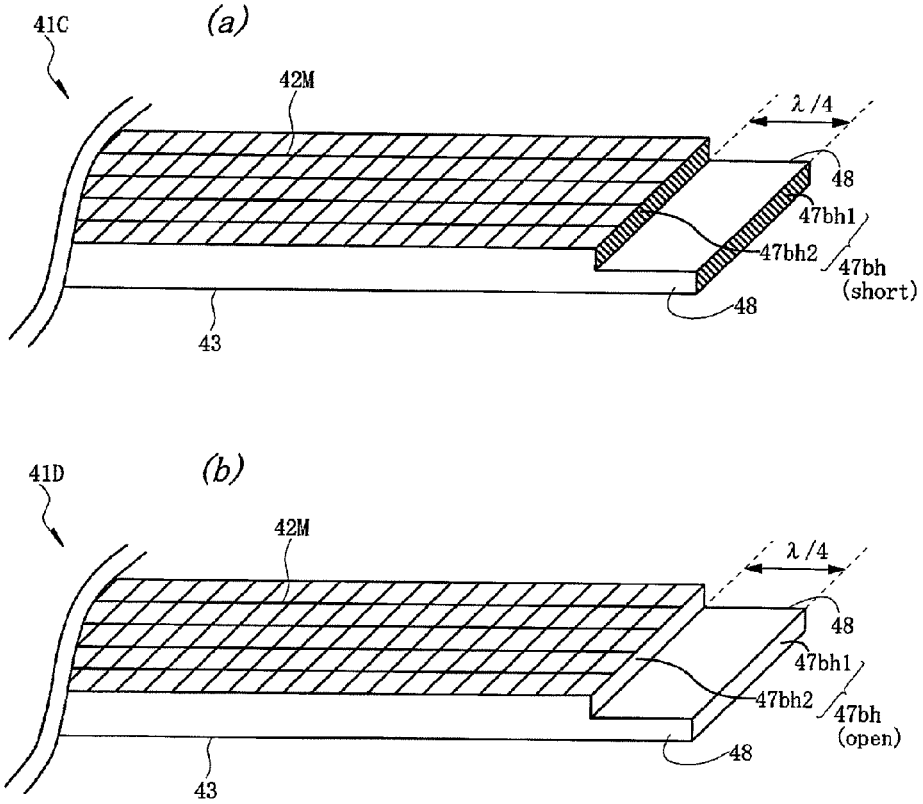
FIG. 17 is a perspective view illustrating enlarged main portions of the electromagnetic wave propagation medium in which the first end surface has a step difference according to Embodiment 4 of the invention, where (*a*) and (*b*) are perspective views respectively illustrating third and fourth electromagnetic wave propagation media including the first conductive layers with a mesh shape.

FIG. 17(*a*) is a perspective view illustrating enlarged main portions of a third electromagnetic wave propagation medium 41C according to Embodiment 4.

The electromagnetic wave propagation medium 41C has two surfaces (first end surfaces 47*bh*1 and 47*bh*2) with different distances from the electromagnetic wave input interface, and one first end surface 47*bh* which reflects an electromagnetic wave in a traveling direction of the electromagnetic wave is divided into two surfaces (first end surfaces 47*bh*1 and 47*bh*2) such that a step difference occurs in an extending direction of the long side. In other words, the first conductive layer 42M along a long side of the electromagnetic wave propagation medium 41A is formed so as to be shorter than the second conductive layer 43.

In the electromagnetic wave propagation medium 41C, the first end surface 47*bh*1 and the first end surface 47*bh*2 are short-circuited. In addition, in the first end surface 47*bh*1 and the first end surface 47*bh*2, there is a difference of $\lambda/4+n\cdot\lambda/2$ at a distance in a direction in which the long side of the electromagnetic wave propagation medium 41C extends. Thereby, in the same manner as the electromagnetic wave propagation medium 41A, in the standing wave S1*a* and the standing wave S1*b*, the loops and the nodes of each other appear at the same position and thus cancel out each other, thereby reducing influence of the standing waves in the electromagnetic wave propagation.

FIG. 17(*b*) is a perspective view illustrating enlarged main portions of a fourth electromagnetic wave propagation medium 41D according to Embodiment 4.

The electromagnetic wave propagation medium 41D has a configuration in which the first end surface 47*bh*1 and the first end surface 47*bh*2 are open-circuited in the above-described electromagnetic wave propagation medium 41C. Thereby, in the same manner as the electromagnetic wave propagation medium 41B, in the standing wave S2*a* and the standing wave S2*b*, the loops and the nodes of each other appear at the same position and thus cancel out each other, thereby reducing influence of the standing wave in the electromagnetic wave propagation space.

Figure 18:
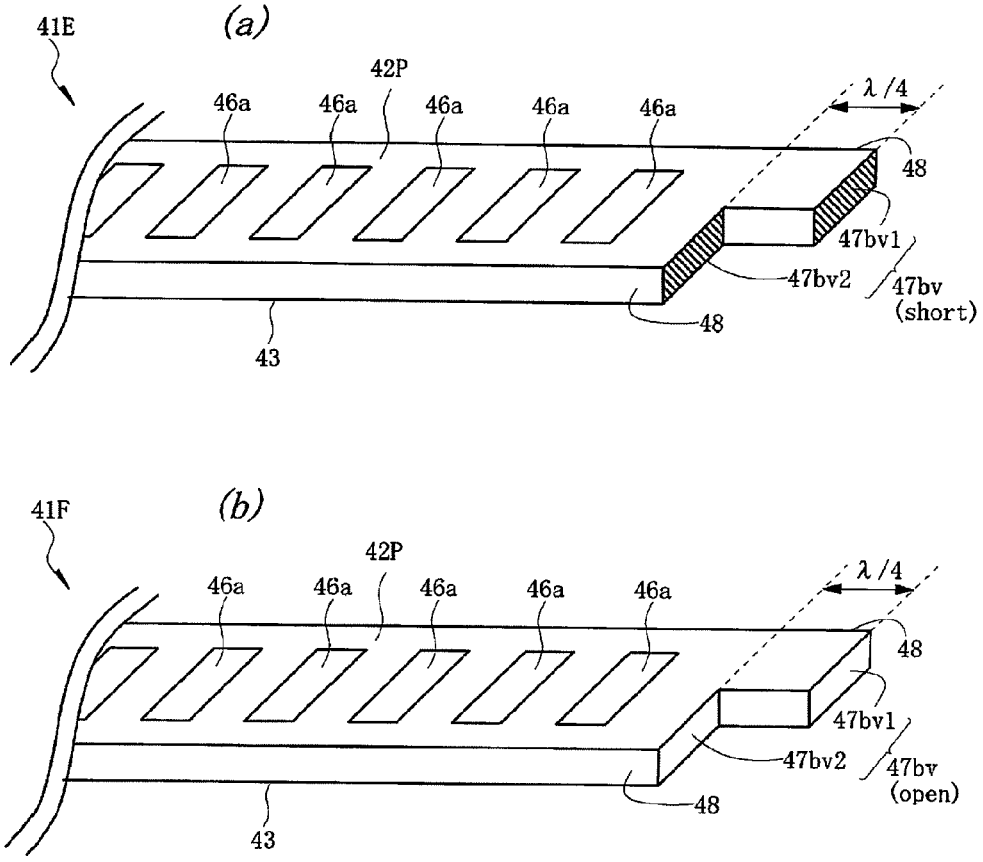
FIG. 18 is a perspective view illustrating enlarged main portions of the electromagnetic wave propagation medium in which the first end surface has a step difference according to Embodiment 4 of the invention, where (*a*) and (*b*) are perspective views respectively illustrating fifth and sixth electromagnetic wave propagation media including the first conductive layers with a plate shape.

FIGS. 18(*a*) and 18(*b*) are perspective views respectively illustrating enlarged main portions of a fifth electromagnetic wave propagation medium 41E and a sixth electromagnetic wave propagation medium 41F according to Embodiment 4.

In the electromagnetic wave propagation medium 41E, a plate-shaped first conductive layer 42P is formed instead of the mesh-shaped first conductive layer 42M forming the above-described electromagnetic wave propagation medium 41A, and a plurality of electromagnetic wave output interfaces 46*a* are installed in the first conductive layer 42P. Similarly, in the electromagnetic wave propagation medium 41F, a plate-shaped first conductive layer 42P is formed instead of the mesh-shaped first conductive layer 42M forming the above-described electromagnetic wave propagation medium 41B, and a plurality of electromagnetic wave output interfaces 46*a* are installed in the first conductive layer 42P. The plurality of electromagnetic wave output interfaces 46*a* are, for example, slots which are opened in the first conductive layer 42P.

Also in the electromagnetic wave propagation media 41E and 41F, influence of a standing wave is reduced, and thus the electromagnetic wave output interfaces 46*a* may be installed at any position of the electromagnetic wave propagation media 41E and 41F.

Figure 19:
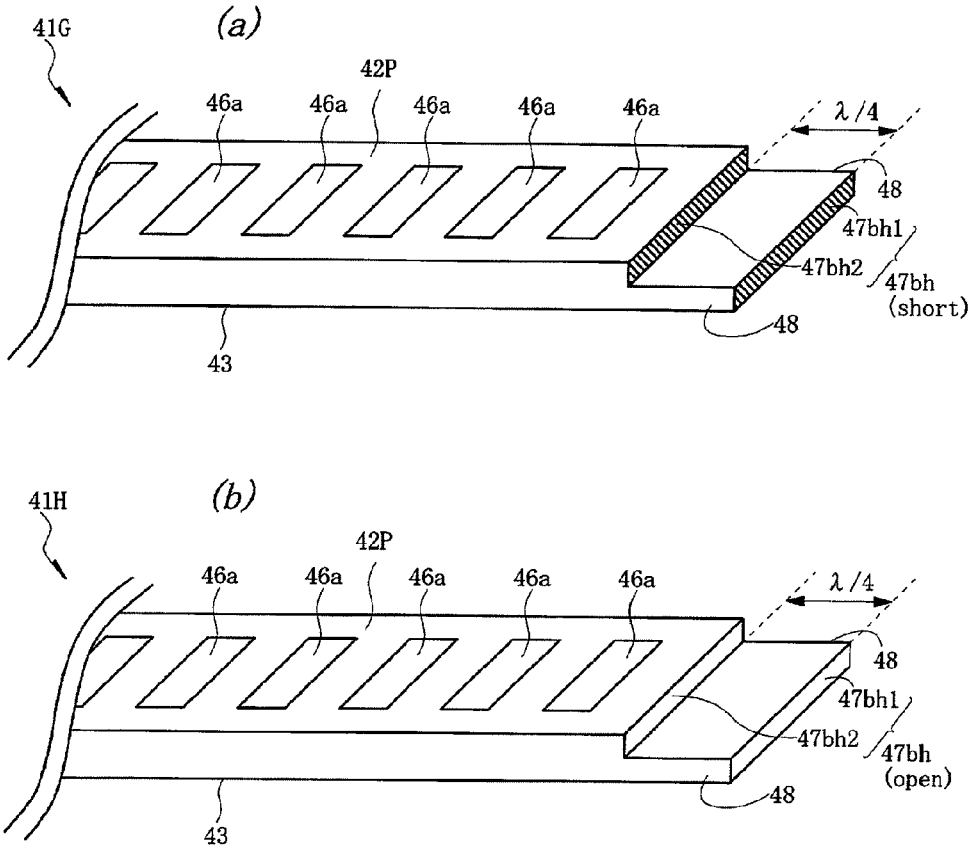
FIG. 19 is a perspective view illustrating enlarged main portions of the electromagnetic wave propagation medium in which the first end surface has a step difference according to Embodiment 4 of the invention, where (*a*) and (*b*) are perspective views respectively illustrating seventh and eighth electromagnetic wave propagation media including the first conductive layers with a plate shape.

FIGS. 19(*a*) and 19(*b*) are perspective views respectively illustrating enlarged main portions of a seventh electromagnetic wave propagation medium 41G and an eighth electromagnetic wave propagation medium 41H according to Embodiment 4.

In the electromagnetic wave propagation medium 41G, a plate-shaped first conductive layer 42P is formed instead of the mesh-shaped first conductive layer 42M forming the above-described electromagnetic wave propagation medium 41C, and a plurality of electromagnetic wave output interfaces 46*a* are installed in the first conductive layer 42P. Similarly, in the electromagnetic wave propagation medium 41H, a plate-shaped first conductive layer 42P is formed instead of the mesh-shaped first conductive layer 42M forming the above-described electromagnetic wave propagation medium 41D, and a plurality of electromagnetic wave output interfaces 46*a* are installed in the first conductive layer 42P. The plurality of electromagnetic wave output interfaces 46*a* are, for example, slots which are opened in the first conductive layer 42P.

Also in the electromagnetic wave propagation media 41G and 41H, influence of a standing wave is reduced, and thus the electromagnetic wave output interfaces 46*a* may be installed at any position of the electromagnetic wave propagation media 41G and 41H.

Embodiment 5

Figure 20:
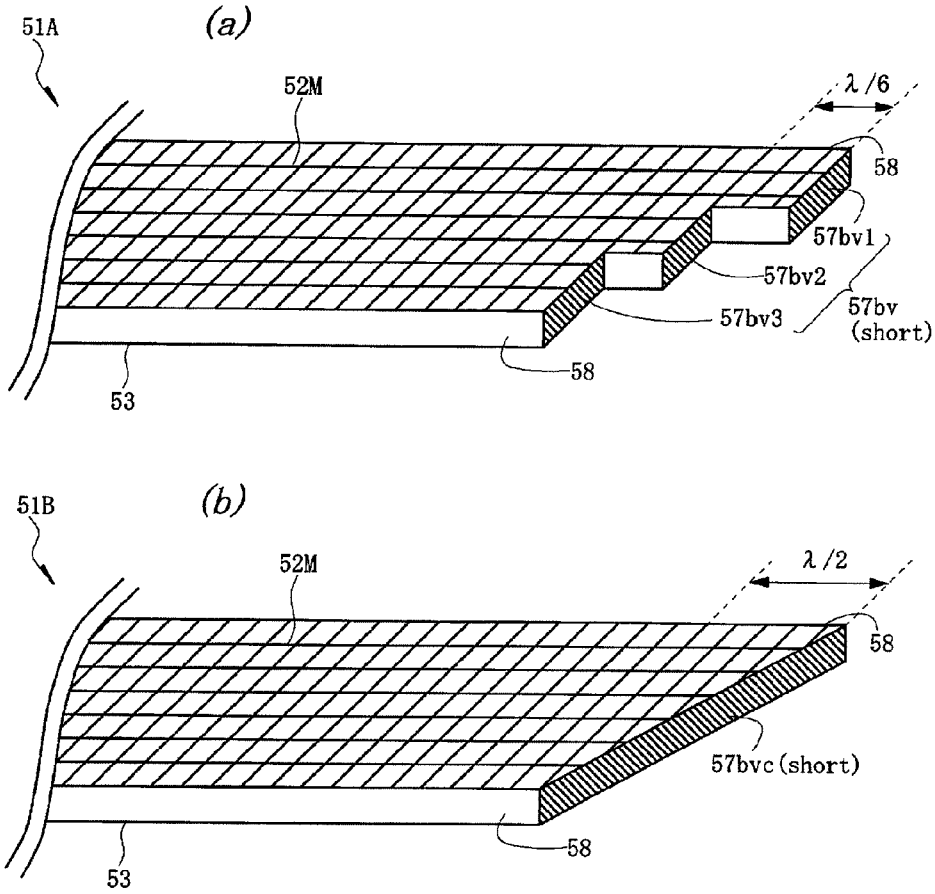
FIG. 20 is a perspective view illustrating enlarged main portions of an electromagnetic wave propagation medium according to Embodiment 5 of the invention, where (*a*) and (*b*) are perspective views respectively illustrating a first electromagnetic wave propagation medium including a first conductive layer with a mesh shape in which a first end surface has a plurality of step differences and a second electromagnetic wave propagation medium including the first conductive layer with a mesh shape in which the first end surface is inclined.
Figure 21:
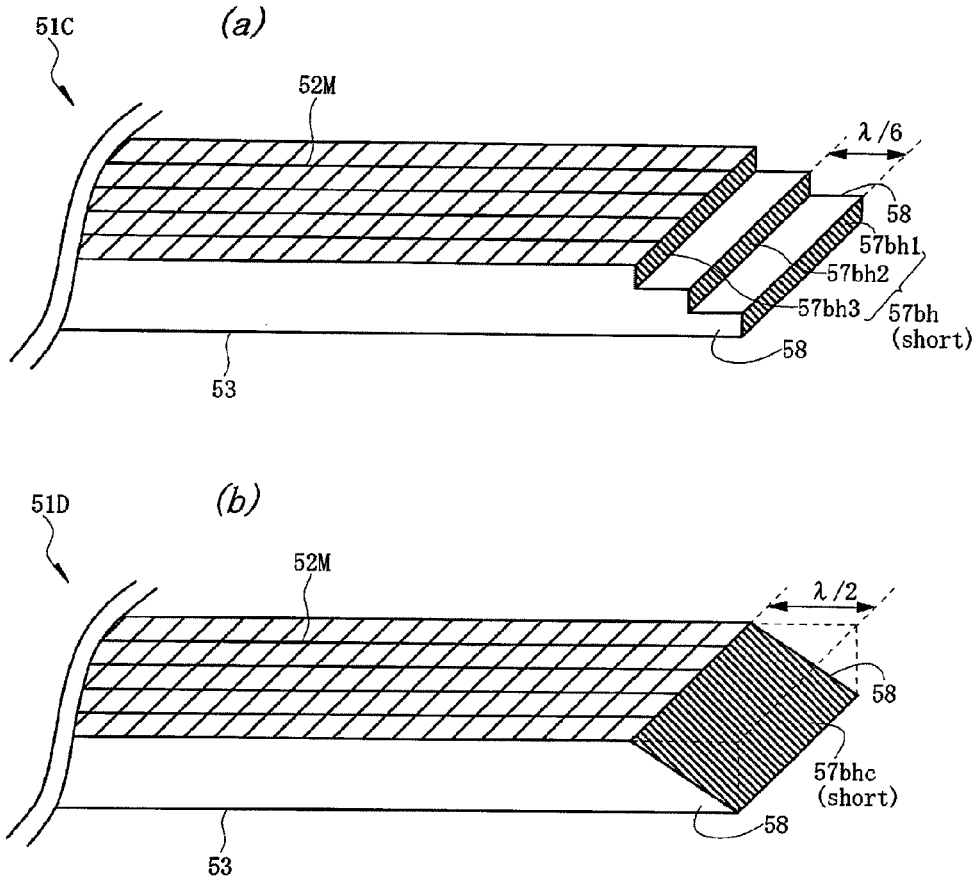
FIG. 21 is a perspective view illustrating enlarged main portions of the electromagnetic wave propagation medium according to Embodiment 5 of the invention, where (*a*) and (*b*) are perspective views respectively illustrating a third electromagnetic wave propagation medium including the first conductive layer with a mesh shape in which the first end surface has a plurality of step differences and a fourth electromagnetic wave propagation medium including the first conductive layer with a mesh shape in which the first end surface is inclined.
Figure 22:
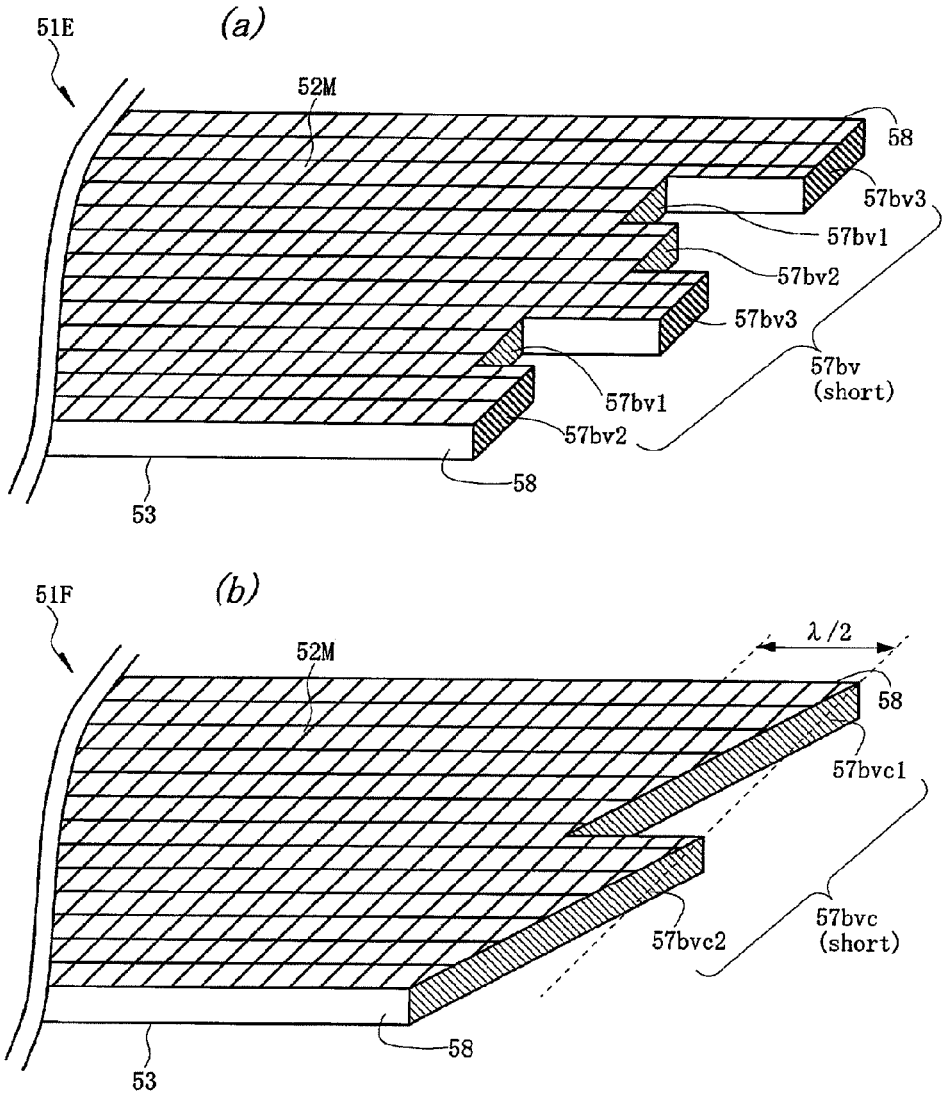
FIG. 22 is a perspective view illustrating enlarged main portions of the electromagnetic wave propagation medium according to Embodiment 5 of the invention, where (*a*) and (*b*) are perspective views respectively illustrating a fifth electromagnetic wave propagation medium including the first conductive layer with a mesh shape in which the first end surface has a plurality of step differences and a sixth electromagnetic wave propagation medium including the first conductive layer with a mesh shape in which the first end surface is inclined.

An electromagnetic wave propagation medium according to Embodiment 5 will be described with reference to FIGS. 20 to 22. FIGS. 20 to 22 are perspective views illustrating enlarged main portions of an electromagnetic wave propagation medium.

In the electromagnetic wave propagation medium according to Embodiment 5, in the same manner as Embodiment 4, a shape of a first end surface which reflects an electromagnetic wave in a traveling direction of the electromagnetic wave is adjusted so as to reduce influence of a standing wave. In Embodiment 5, a description will be made of a shape in which the first end surface which reflects an electromagnetic wave is given a step difference and is divided into m (m≥3).

FIG. 20(*a*) is a perspective view illustrating enlarged main portions of a first electromagnetic wave propagation medium 51A according to Embodiment 5.

The electromagnetic wave propagation medium 51A has a structure in which a planar electromagnetic wave propagation space is interposed between a mesh-shaped first conductive layer 52M and a plate-shaped second conductive layer 53 on upper and lower sides, and includes at least one electromagnetic wave input interface provided in the first conductive layer 52M. Further, the electromagnetic wave propagation medium 51A has a strip shape with a long side in a traveling direction (a first direction) of a propagated electromagnetic wave and a short side in a direction (a second direction) perpendicular to the traveling direction of the electromagnetic wave.

Further, the electromagnetic wave propagation medium 51A has three surfaces (first end surfaces 57*bv*1, 57*bv*2 and 57*bv*3) with different distances from the electromagnetic wave input interface, and one first end surface 57*bv* which reflects an electromagnetic wave in a traveling direction of the electromagnetic wave is divided into three surfaces (first end surfaces 57*bv*1, 57*bv*2 and 57*bv*3) such that a step difference occurs in an extending direction of the short side. One second end surface 58 along a long side of the electromagnetic wave propagation medium 51A is formed so as to be shorter than the other second end surface 58.

In the electromagnetic wave propagation medium 51A, the first end surface 57*bv*1, the first end surface 57*bv*2, and the first end surface 57*bv*3 are short-circuited. In addition, in the first end surface 57*bv*1 and the first end surface 57*bv*2, and in the first end surface 57*bv*2 and the first end surface 57*bv*3, there is a difference of $\lambda/6+n\cdot\lambda/2$ ((1, 2, . . . , and $m-1)\cdot\lambda/(2\cdot m)+n\cdot\lambda/2$; m=3) at a distance in a direction in which the long side of the electromagnetic wave propagation medium 51A extends. When expressed in a phase, there is a difference of $\pi/3+n\cdot\pi$ ((1, 2, . . . , and $m-1)\cdot\pi/m+n\cdot\pi$; m=3). In addition, since standing waves generated by the first end surface 57*bv*1, the first end surface 57*bv*2, and the first end surface 57*bv*3 have a phase difference of 60 degrees, in the same manner as the above-described electromagnetic wave propagation medium 41A, the loops and the nodes of the standing waves cancel out each other, and thereby it is possible to reduce influence of the standing waves in the electromagnetic wave propagation space.

As above, even if the first end surface 57*bv* is formed in not only two surfaces but also three or more surfaces, the same effect can be achieved. In addition, even if the first end surfaces 57*bv*1, 57*bv*2 and 57*bv*3 are not only short-circuited but also open-circuited, the same effect can be achieved.

FIG. 20(*b*) is a perspective view illustrating enlarged main portions of a second electromagnetic wave propagation medium 51B according to Embodiment 5.

The electromagnetic wave propagation medium 51B has a configuration in which the number of divided surfaces of the first end surface 57*bv* forming the above-described electromagnetic wave propagation medium 51A increases, and a first end surface 57*bvc* is obliquely formed in an extending direction of the short side over a length of $n\cdot\lambda/2$ in an extending direction of the long side.

In the electromagnetic wave propagation medium 51B, the first end surface 57*bvc* is short-circuited. It is possible to reduce influence of a standing wave equally to a case of increasing the number of surfaces of the first end surfaces 57*bv*1, 57*bv*2 and 57*bv*3 forming the above-described electromagnetic wave propagation medium 51A. In addition, even if the first end surface 57*bvc* is open-circuited, the same effect can be achieved.

FIG. 21(*a*) is a perspective view illustrating enlarged main portions of a third electromagnetic wave propagation medium 51C according to Embodiment 5.

The electromagnetic wave propagation medium 51C has three surfaces (first end surfaces 57*bh*1, 57*bh*2 and 57*bh*3) with different distances from the electromagnetic wave input interface, and one first end surface 57*bh* which reflects an electromagnetic wave in a traveling direction of the electromagnetic wave is divided into three surfaces (first end surfaces 57*bh*1, 57*bh*2 and 57*bh*3) such that a step difference occurs in an extending direction of the long side. In other words, the first conductive layer 52M along a long side of the electromagnetic wave propagation medium 51C is formed so as to be shorter than the second conductive layer 53.

In the electromagnetic wave propagation medium 51C, the first end surface 57*bh*1, the first end surface 57*bh*2, and the first end surface 57*bh*3 are short-circuited. In addition, in the first end surface 57*bh*1 and the first end surface 57*bh*2, and in the first end surface 57*bh*2 and the first end surface 57*bh*3, there is a difference of $\lambda/6+n\cdot\lambda/2$ ((1, 2, . . . , and $m-1)\cdot\lambda/(2\cdot m)+n\cdot\lambda/2$; m=3) at a distance in a direction in which the long side of the electromagnetic wave propagation medium 51E extends. When expressed in a phase, there is a difference of $\pi/3+n\cdot\pi$ ((1, 2, . . . , and $m-1)\cdot\pi/m+n\cdot\pi$; m=3). In addition, since standing waves generated by the first end surface 57*bh*1, the first end surface 57*bh*2, and the first end surface 57*bh*3 have a phase difference of 60 degrees, in the same manner as the above-described electromagnetic wave propagation medium 41G, the loops and the nodes of the standing waves cancel out each other, and thereby it is possible to reduce influence of the standing waves in the electromagnetic wave propagation space.

Even if the first end surface 57*bh*1, the first end surface 57*bh*2, and the first end surface 57*bh*3 are not only short-circuited but also open-circuited, the same effect can be achieved.

FIG. 21(*b*) is a perspective view illustrating enlarged main portions of a fourth electromagnetic wave propagation medium 51D according to Embodiment 5.

The electromagnetic wave propagation medium 51D has a configuration in which the number of divided surfaces of the first end surface 57*bh* forming the above-described electromagnetic wave propagation medium 51C increases, and a first end surface 57*bhc* is obliquely formed in an extending direction of the short side over a length $n\cdot\lambda/2$ in an extending direction of the long side.

In the electromagnetic wave propagation medium 51D, the first end surface 57*bhc* is short-circuited. It is possible to reduce influence of a standing wave equally to a case of increasing the number of surfaces of the first end surfaces 57*bh*1, 57*bh*2 and 57*bh*3 forming the above-described electromagnetic wave propagation medium 51C. In addition, even if the first end surface 57*bhc* is open-circuited, the same effect can be achieved.

FIG. 22(*a*) is a perspective view illustrating enlarged main portions of a fifth electromagnetic wave propagation medium 51E according to Embodiment 5.

The electromagnetic wave propagation medium 51E has a plurality of surfaces (first end surfaces 57*bv*1, 57*bv*2 and 57*bv*3) with different distances from the electromagnetic wave input interface, and one first end surface 57*bv* which reflects an electromagnetic wave in a traveling direction of the electromagnetic wave is divided into a plurality of surfaces (first end surfaces 57*bv*1, 57*bv*2 and 57*bv*3) such that a step difference occurs in an extending direction of the long side. In other words, the electromagnetic wave propagation medium 51E has the first end surface 57*bv* in which three first end surfaces 57*bv*1, 57*bv*2 and 57*bv*3 forming the first end surface 57*bv* of the above-described electromagnetic wave propagation medium 51A are repeated. Thereby, in the same manner as the above-described electromagnetic wave propagation medium 41A, the loops and the nodes of the standing waves cancel out each other, and thus it is possible to reduce influence of the standing waves in the electromagnetic wave propagation space.

In addition, even if the first end surfaces 57*bv*1, 57*bv*2 and 57*bv*3 are not only short-circuited but also open-circuited, the same effect can be achieved. Further, a width in the extending direction of the short side of the first end surfaces 57*bv*1, 57*bv*2 and 57*bv*3 is preferably $\lambda/4$ or more.

FIG. 22(*b*) is a perspective view illustrating enlarged main portions of a sixth electromagnetic wave propagation medium 51F according to Embodiment 5.

The electromagnetic wave propagation medium 51F has a configuration in which the number of divided surfaces of the first end surface 57*bv* forming the above-described electromagnetic wave propagation medium 51E increases, and a first end surface 57*bvc* is obliquely formed in an extending direction of the short side over a length of $n\cdot\lambda/2$ in an extending direction of the long side, and has two surfaces (first end surfaces 57*bvc*1 and 57*bvc*2). Thereby, it is possible to reduce influence of standing waves in the same manner as the above-described electromagnetic wave propagation medium 51E.

In addition, even if the first end surfaces 57*bvc*1 and 57*bvc*2 are not only short-circuited but also open-circuited, the same effect can be achieved. Further, a width in the extending direction of the short side of the first end surfaces 57*bvc*1 and 57*bvc*2 is preferably $\lambda/4$ or more.

In addition, an electromagnetic wave propagation medium may be configured to have a first end surface 57*bh* in which three first end surfaces 57*bh*1, 57*bh*2 and 57*bh*3 forming the first end surface 57*bh* of the above-described electromagnetic wave propagation medium 51C are repeated, or a plurality of first end surfaces 57*bhc* of the above-described electromagnetic wave propagation medium 51D.

Further, although the mesh-shaped first conductive film 52M is formed in the above-described electromagnetic wave propagation media 51A to 51F, a plate-shaped first conductive layer may be formed instead of the mesh-shaped first conductive layer 52M and a plurality of electromagnetic wave output interfaces may be formed in the first conductive layer, and it is possible to reduce influence of standing waves in the same manner. In addition, in this case, since influence of a standing wave is reduced, an electromagnetic wave output interface may be installed at any position of the electromagnetic wave propagation medium.

Embodiment 6

Figure 23:
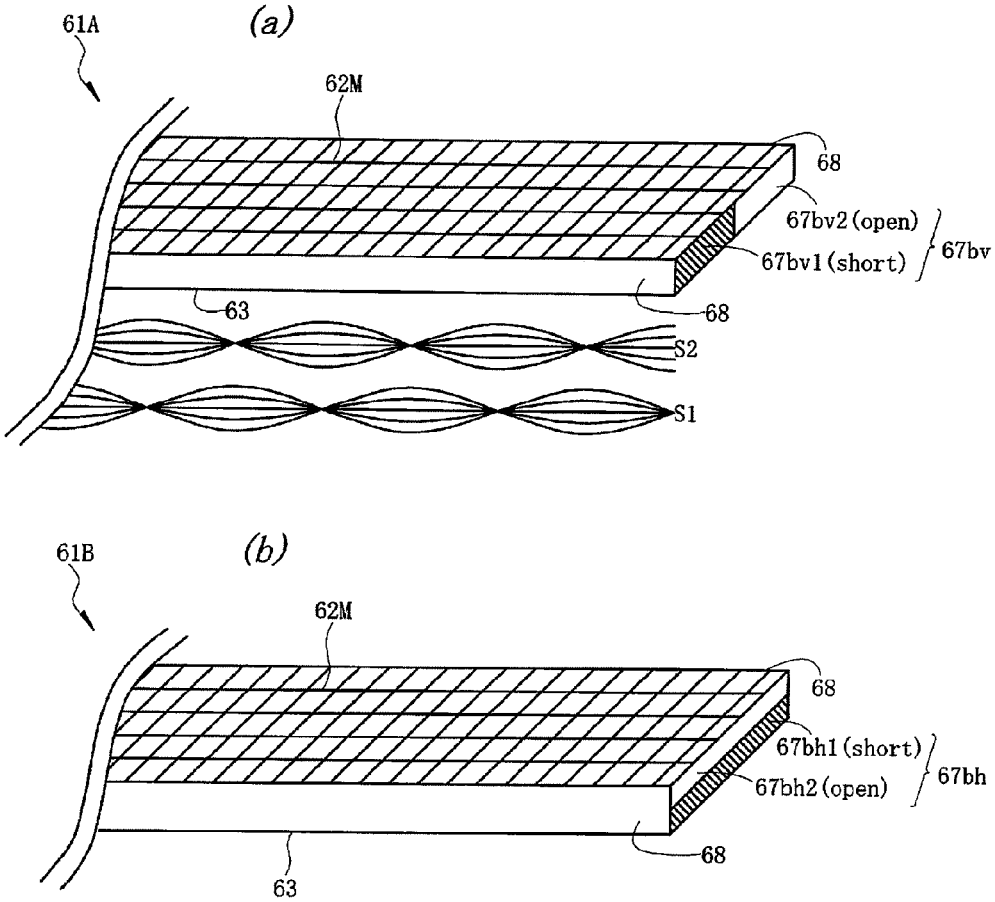
FIG. 23 is a perspective view illustrating enlarged main portions of an electromagnetic wave propagation medium including a first end surface having two short-circuited and open-circuited surfaces according to Embodiment 6 of the invention, where (*a*) and (*b*) are perspective views respectively illustrating first and second electromagnetic wave propagation media including first conductive layers with a mesh shape.
Figure 24:
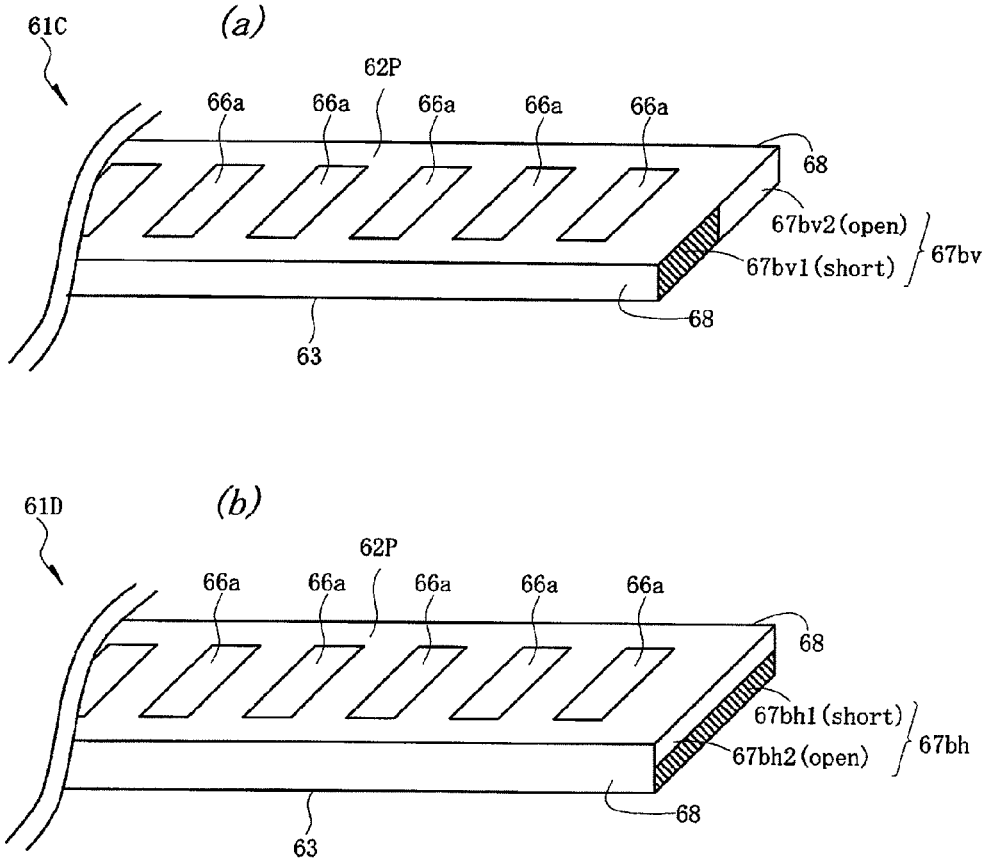
FIG. 24 is a perspective view illustrating enlarged main portions of the electromagnetic wave propagation medium including the first end surface having two short-circuited and open-circuited surfaces according to Embodiment 6 of the invention, where (*a*) and (*b*) are perspective views respectively illustrating third and fourth electromagnetic wave propagation media including first conductive layers with a plate shape.
Figure 25:
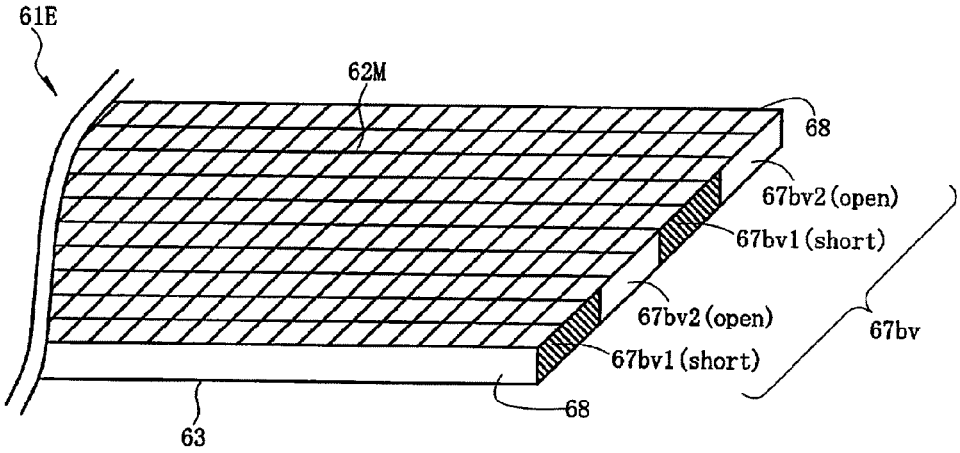
FIG. 25 is a perspective view illustrating enlarged main portions of a sixth electromagnetic wave propagation medium including the first end surface with a mesh shape in which a short-circuited surface and an open-circuited surface are alternately disposed and including the first conductive layer with a mesh shape according to Embodiment 6 of the invention.

An electromagnetic wave propagation medium according to Embodiment 6 will be described with reference to FIGS. 23 to 25. FIGS. 23 to 25 are perspective views illustrating enlarged main portions of an electromagnetic wave propagation medium.

In the electromagnetic wave propagation medium according to Embodiment 6, in the same manner as above-described Embodiments 4 and 5, a shape of a first end surface which reflects an electromagnetic wave in a traveling direction of the electromagnetic wave is adjusted so as to reduce influence of a standing wave. In Embodiment 6, a description will be made of a shape in which the first end surface which reflects an electromagnetic wave is not given a step difference and is divided into m ($m\geq 2$).

FIG. 23(*a*) is a perspective view illustrating enlarged main portions of a first electromagnetic wave propagation medium 61A according to Embodiment 6.

The electromagnetic wave propagation medium 61A has a structure in which a planar electromagnetic wave propagation space is interposed between a mesh-shaped first conductive layer 62M and a plate-shaped second conductive layer 63 on upper and lower sides, and includes at least one electromagnetic wave input interface provided in the first conductive layer 62M. Further, the electromagnetic wave propagation medium 61A has a strip shape with a long side in a traveling direction (a first direction) of a propagated electromagnetic wave and a short side in a direction (a second direction) perpendicular to the traveling direction of the electromagnetic wave.

In addition, in the electromagnetic wave propagation medium 61A, one first end surface 67*bv* which reflects an electromagnetic wave in a traveling direction of the electromagnetic wave is divided into two almost at the center in an extending direction of the short side, and has two surfaces (67*bv*1 and 67*bv*2) including one surface which is short-circuited and the other surface which is open-circuited. In other words, a conductive layer is formed at almost half (the first end surface 67*bv*1) of the first end surface 67*b* on one second lateral surface 68 side along the long side of the electromagnetic wave propagation medium 61A, and the first conductive layer 62M is connected to the second conductive layer 63 via the conductive layer. In contrast, a conductive layer is not formed at almost half (the first end surface 67*bv*2) of the first end surface 67*b* on the other second lateral surface 68 side along the long side of the electromagnetic wave propagation medium 61A. In the first end surface 67*bv*1 and the first end surface 67*bv*2, when expressed in a phase, there is a difference of $\pi/2+n\cdot\pi$ ((1, 2, . . . , and $m-1)\cdot\pi/m+n\cdot\pi$; $m=2$). Two second end surfaces 68 and 68 may be short-circuited or open-circuited.

In the electromagnetic wave propagation medium 61A, since a standing wave S1 generated by one first end surface 67*bv*1 and a standing wave S2 generated by the other first end surface 67*bv*2 have a phase difference of 90 degrees, the loops and the nodes of the standing waves cancel out each other, and thereby it is possible to reduce influence of the standing waves in the electromagnetic wave propagation space.

FIG. 23(*b*) is a perspective view illustrating enlarged main portions of a second electromagnetic wave propagation medium 61B according to Embodiment 6.

In the electromagnetic wave propagation medium 61B, one first end surface 67*bv* which reflects an electromagnetic wave in a traveling direction of the electromagnetic wave is divided into two surfaces (67*bh*1 and 67*bh*2) including a short-circuited surface and an open-circuited surface in the same manner as the above-described electromagnetic wave propagation medium 61A, but division directions are different. In other words, one first end surface 67*bh* which reflects an electromagnetic wave in a traveling direction of the electromagnetic wave is divided into two almost at the center in a thickness direction of the electromagnetic wave propagation space, and, a conductive layer is formed in one first end surface 67*bh*1 on the second conductive layer 63 side and a conductive layer ML is not formed in the first end surface 67*bh*2 on the first conductive layer 62M side. In the first end surface 67*bh*1 and the first end surface 67*bh*2, when expressed in a phase, there is a difference of $\pi/2+n\cdot\pi$ ((1, 2, . . . , and $m-1)\cdot\pi/m+n\cdot\pi t$; m=2).

In the electromagnetic wave propagation medium 61B, in the same manner as the above-described electromagnetic wave propagation medium 61A, since the loops and the nodes of the standing waves cancel out each other, it is possible to reduce influence of the standing waves in the electromagnetic wave propagation space.

FIGS. 24(*a*) and 24(*b*) are perspective views respectively illustrating enlarged main portions of a third electromagnetic wave propagation medium 61C and a fourth electromagnetic wave propagation medium 61D according to Embodiment 6.

In addition, in the electromagnetic wave propagation medium 61C, in the same manner as the electromagnetic wave propagation medium 61A, one first end surface 67*bv* which reflects an electromagnetic wave in a traveling direction of the electromagnetic wave is divided into two almost at the center in an extending direction of the short side, and has two surfaces (67*bv*1 and 67*bv*2) including one surface which is short-circuited and the other surface which is open-circuited. A plate-shaped first conductive layer 62P is formed instead of the mesh-shaped first conductive layer 62M forming the above-described electromagnetic wave propagation medium 61A, and a plurality of electromagnetic wave output interfaces 66*a* are installed in the first conductive layer 62P.

In the electromagnetic wave propagation medium 61D, in the same manner as the electromagnetic wave propagation medium 61B, one first end surface 67*bh* which reflects an electromagnetic wave in a traveling direction of the electromagnetic wave is divided into two almost at the center in a thickness direction of the electromagnetic wave propagation space, and has two surfaces (6*bh*1 and 67*bh*2) including one surface which is short-circuited and the other surface which is open-circuited. A plate-shaped first conductive layer 62P is formed instead of the mesh-shaped first conductive layer 62M forming the above-described electromagnetic wave propagation medium 61B, and a plurality of electromagnetic wave output interfaces 66*a* are installed in the first conductive layer 62P.

A plurality of electromagnetic wave output interfaces 66*a* are, for example, slots which are opened in the first conductive layer 62P. Since influence of standing waves is reduced in the configurations of the electromagnetic wave propagation media 61C and 61D, the electromagnetic wave output interface 66*a* may be installed at any position of the electromagnetic wave propagation media 61C and 61D.

FIG. 25 is a perspective view illustrating enlarged main portions of a fifth electromagnetic wave propagation medium 61E according to Embodiment 6.

In addition, in the electromagnetic wave propagation medium 61E, one first end surface 67*bv* which reflects an electromagnetic wave in a traveling direction of the electromagnetic wave is divided into four in an extending direction of the short side, and short-circuited surfaces (first end surface 67*bv*1) and open-circuited surfaces (first end surface 67*bv*2) are alternately disposed. In the same manner as the electromagnetic wave propagation medium 61A, in the electromagnetic wave propagation medium 61E, since a standing wave S1 generated by one first end surface 67*bv*1 and a standing wave S2 generated by the other first end surface 67*bv*2 have a phase difference of 90 degrees, the loops and the nodes of the standing waves cancel out each other, and thereby it is possible to reduce influence of the standing waves in the electromagnetic wave propagation medium 61E.

In addition, a width in the extending direction of the short side of the first end surfaces 67*bv*1 and 67*bv*2 is preferably $\lambda/4$ or more. Further, since influence of standing waves is reduced in the configuration of the electromagnetic wave propagation medium 61E, the electromagnetic wave output interface may be installed at any position of the electromagnetic wave propagation medium 61E.

In the above-described electromagnetic wave propagation media 61B to 61D, in the same manner as the above-described electromagnetic wave propagation medium 61E, the first end surfaces 67*bv* and 67*bh* may be divided into a plurality of surfaces, thus the loops and the nodes of the standing waves cancel out each other, and thereby it is possible to reduce influence of the standing waves in the electromagnetic wave propagation space.

Embodiment 7

In above-described Embodiment 4, Embodiment 5, and Embodiment 6, a description has been made of the structure and effect of each of the electromagnetic wave propagation media 41A to 41H, 51A to 51F and 61A to 61E which can reduce influence of standing waves by adjusting a shape of the first end surface which reflects an electromagnetic wave in a traveling direction of the electromagnetic wave.

In Embodiment 7, modified examples in which other forms are combined with the electromagnetic wave propagation media 41A to 41H, 51A to 51F and 61A to 61E will be described.

(1) The electromagnetic wave propagation media 61A to 61E in which one first end surface which reflects an electromagnetic wave in a traveling direction of the electromagnetic wave is divided into a plurality of surfaces (for example, two or four surfaces) in an extending direction of the short side and a short-circuited surface and an open-circuited surface are alternately disposed may be combined with the electromagnetic wave propagation media 41A to 41H and 51A to 51F in which surfaces of which distances in an extending direction of the long side are different are formed.

(2) In addition, a complex of electromagnetic wave propagation media including a plurality of electromagnetic wave propagation media may be used. For example, each of the first end surface 47*bv*1 and the first end surface 47*bv*2 of the electromagnetic wave propagation medium 41A may used as a single electromagnetic wave propagation medium, and the two electromagnetic wave propagation media may be combined. In addition, three electromagnetic wave propagation media may be combined in the same manner for the first end surfaces 57*bv*1, 57*bv*2 and 57*bv*3 of the electromagnetic wave propagation medium 51A. Further, the first end surfaces 61*bv*1 and 61*bv*2 of the electromagnetic wave propagation medium 61A may be formed by a combination of two electromagnetic wave propagation media.

(3) In addition, Embodiments 4, 5 and 6 described above reduce influence of standing waves but may be combined with Embodiment 1 described above by using a standing wave of which influence is reduced in an extending direction of the long side and a standing wave in an extending direction of the short side. As an example, a description will be made of an electromagnetic wave propagation medium in which the configuration of the electromagnetic wave propagation medium 61C is combined with the configuration of the electromagnetic wave propagation medium 1E. A single electromagnetic wave input interface and a plurality of electromagnetic wave output interfaces may be provided in the electromagnetic wave propagation medium 61C, and, the more distant the electromagnetic wave output interface is from the electromagnetic input interface, the closer to a distance of $\lambda/4+n\cdot\lambda/2$ from one second end surface the electromagnetic wave output interface may be installed.

With this configuration, it is possible to implement an electromagnetic wave propagation medium which enables power to easily arrive at an electromagnetic wave output interface distant from an electromagnetic wave input interface by using a standing wave in an extending direction of the short side while reducing influence of a standing wave in an extending direction of the long side of the electromagnetic wave propagation medium.

(4) Above-described Embodiment 2 may be combined with above-described Embodiments 4, 5 and 6. In the configurations of the electromagnetic wave propagation media 41A to 41H, 51A to 51F and 61A to 61E, an electromagnetic wave input interface is provided, the first conductive layer is formed of conductor mesh, and, the more distant a location is from the electromagnetic wave input interface, the sparser the conductor mesh of the first conductive layer is. Alternatively, an electromagnetic wave output interface (slot) which has conductor mesh in an opening portion thereof is formed, and, the more distant the electromagnetic wave output interface is from the electromagnetic wave input interface, the sparser the conductor mesh is.

With this configuration, it is possible to implement an electromagnetic wave propagation medium which enables power to easily arrive at an electromagnetic wave output interface distant from an electromagnetic wave input interface while reducing influence of a standing wave in the electromagnetic wave propagation medium.

(5) In addition, above-described Embodiment 3 may be combined with above-described Embodiments 4, 5 and 6. In the configurations of the electromagnetic wave propagation media 41A to 41H, 51A to 51F and 61A to 61E, an electromagnetic wave input interface is provided, the more distant a location is from the electromagnetic wave input interface, the shorter the distance between the front surface (the surface on an opposite side to the surface which comes into contact with the electromagnetic wave propagation space) of the first conductive layer and the rear surface (the surface which comes into contact with the electromagnetic wave propagation space) of the second conductive layer may be.

(6) In addition, a plurality of Embodiment 1, Embodiment 2 and Embodiment 3 may be combined with above-described Embodiments 4, 5 and 6, and thereby it is possible to implement an electromagnetic wave propagation medium which enables power to easily arrive at an electromagnetic wave output interface distant from an electromagnetic wave input interface while reducing influence of a standing wave.

As described above, when the configuration of the electromagnetic wave propagation medium according to Embodiment 7 is applied, an end surface of the electromagnetic wave propagation medium is adjusted, and thereby it is possible to implement an electromagnetic wave propagation medium which reduces influence of a standing wave. Thereby, a restriction on an installation location of an electromagnetic wave output interface is alleviated.

In addition, communication devices may be installed in the configurations of Embodiments 4, 5, 6 and 7, and communication can be performed between the communication devices. At this time, since influence of a standing wave is reduced in the electromagnetic wave propagation medium, an installation interval of the communication devices may be set according to circumstances of the communication devices, for example, a size or the like.

As above, although the inventions made by the present inventor have been described in detail based on the embodiments, the invention is not limited to the above-described embodiments and may have various modifications in the scope without departing from the spirit thereof.

INDUSTRIAL APPLICABILITY

The invention is applicable to an electromagnetic wave propagation medium which is used for a signal transmission system and the like and propagates an electromagnetic wave.

The invention claimed is:

1. An electromagnetic wave propagation medium comprising:

a first conductive layer;

a second conductive layer;

an electromagnetic wave propagation space that is interposed between the first conductive layer and the second conductive layer on upper and lower sides;

at least one electromagnetic wave input interface;

a plurality of electromagnetic wave output interfaces;

long sides in a first direction in which an electromagnetic wave is propagated;

short sides in a second direction perpendicular to the first direction;

two first end surfaces along the short sides opposite to each other with the electromagnetic wave propagation space interposed therebetween; and two second end surfaces along the long sides opposite to each other with the electromagnetic wave propagation space interposed therebetween, wherein, when a wavelength of the electromagnetic wave in the electromagnetic wave propagation space is $\lambda$, and n is an integer, in a case where the first conductive layer and the second conductive layer are short-circuited in an end surface which is one of the first and second end surfaces and which reflects the electromagnetic wave, the more distant the electromagnetic wave output interface is from the electromagnetic wave input interface, the closer to a distance of $\lambda/4+n\cdot\lambda/2$ from the end surface the electromagnetic wave output interface is installed, and in a case where the first conductive layer and the second conductive layer are not short-circuited in the end surface, the more distant the electromagnetic wave output interface is from the electromagnetic wave input interface, the closer to a distance of $n\cdot\lambda/2$ from the end surface the electromagnetic wave output interface is installed.

2. The electromagnetic wave propagation medium according to claim 1, wherein a distance between the two second end surfaces which are opposite to each other is $n\cdot\lambda/2$, wherein the first conductive layer and the second conductive layer are short-circuited in both of the two second end surfaces, and wherein the end surface is the first end surface.

3. The electromagnetic wave propagation medium according to claim 2, wherein the more distant the electromagnetic wave output interface is from the electromagnetic wave input interface, the closer to a distance of $\lambda/4+n\cdot\lambda/2$ from the second end surface the electromagnetic wave output interface is installed.

4. The electromagnetic wave propagation medium according to claim 1, wherein a distance between the two second end surfaces which are opposite to each other is $n\cdot\lambda/2$, wherein the first conductive layer and the second conductive layer are short-circuited in both of the two second end surfaces, and wherein the more distant the electromagnetic wave output interface is from the electromagnetic wave input interface, the closer to a distance of $\lambda/4+n\cdot\lambda/2$ from the second end surface the electromagnetic wave output interface is installed.

5. The electromagnetic wave propagation medium according to claim 4, wherein the end surface is the first end surface.

6. The electromagnetic wave propagation medium according to claim 1, wherein the electromagnetic wave output interface is a slot which is formed in the first conductive layer, or the first conductive layer and the second conductive layer.

7. The electromagnetic wave Propagation medium according to claim 1, wherein the first conductive layer, or the first conductive layer and the second conductive layer include mesh-shaped conductors, and wherein the electromagnetic wave output interface is a mark added to the mesh-shaped conductors.

8. The electromagnetic wave propagation medium according to claim 1, wherein the more distant from the electromagnetic wave input interface is, the shorter the distance between a front surface of the first conductive layer and a rear surface of the second conductive layer is.

9. An electromagnetic wave propagation medium comprising:

a first conductive layer;

a second conductive layer;

an electromagnetic wave propagation space that is interposed between the first conductive layer and the second conductive layer on upper and lower sides;

at least one electromagnetic wave input interface;

long sides in a first direction in which an electromagnetic wave is propagated;

short sides in a second direction perpendicular to the first direction;

two first end surfaces along the short sides opposite to each other with the electromagnetic wave propagation space interposed therebetween; and two second end surfaces along the long sides opposite to each other with the electromagnetic wave propagation space interposed therebetween, wherein the first conductive layer, or the first conductive layer and the second conductive layer include mesh-shaped conductors, and wherein the more distant from the electromagnetic wave input interface the mesh-shaped conductors is, the sparser a mesh density of the mesh-shaped conductors is.

10. The electromagnetic wave propagation medium according to claim 9, further comprising:

a plurality of electromagnetic wave output interfaces, wherein, when a wavelength of the electromagnetic wave in the electromagnetic wave propagation space is $\lambda$, and n is an integer, in a case where the first conductive layer and the second conductive layer are short-circuited in an end surface which is one of the first and second end surfaces and which reflects the electromagnetic wave, the more distant the electromagnetic wave output interface is from the electromagnetic wave input interface, the closer to a distance of $\lambda/4+n\cdot\lambda/2$ from the end surface the electromagnetic wave output interface is installed, and in a case where the first conductive layer and the second conductive layer are not short-circuited in the end surface, the more distant the electromagnetic wave output interface is from the electromagnetic wave input interface, the closer to a distance of $n\cdot\lambda/2$ from the end surface the electromagnetic wave output interface is installed.

11. The electromagnetic wave propagation medium according to claim 9, further comprising:

a plurality of electromagnetic wave output interfaces, wherein, when a wavelength of the electromagnetic wave in the electromagnetic wave propagation space is $\lambda$, and n is an integer, in a case where the first conductive layer and the second conductive layer are short-circuited in an end surface which reflects the electromagnetic wave among the first end surfaces and the second end surfaces, the electromagnetic wave output interface is installed at a distance of $\lambda/4+n\cdot\lambda/2$ from the end surface, and in a case where the first conductive layer and the second conductive layer are not short-circuited in the end surface, the electromagnetic wave output interface is installed at a distance of $n\cdot\lambda/2$ from the end surface.

12. The electromagnetic wave propagation medium according to claim 9, wherein the electromagnetic wave output interface is a slot opened in the first conductive layer or the first conductive layer and the second conductive layer, and the mesh-shaped conductors are formed inside the slot.

13. The electromagnetic wave propagation medium according to claim 9, wherein the more distant from the electromagnetic wave input interface is, the shorter the distance between a front surface of the first conductive layer and a rear surface of the second conductive layer is.

14. An electromagnetic wave propagation medium comprising:

a first conductive layer;

a second conductive layer;

an electromagnetic wave propagation space that is interposed between the first conductive layer and the second conductive layer on upper and lower sides;

long sides in a first direction in which an electromagnetic wave is propagated;

short sides in a second direction perpendicular to the first direction;

two first end surfaces along the short sides opposite to each other with the electromagnetic wave propagation space interposed therebetween; and two second end surfaces along the long sides opposite to each other with the electromagnetic wave propagation space interposed therebetween, wherein, when n is an integer, and $\pi$ is a circular constant, at least one end surface of the first end surfaces and the second end surfaces is divided into m (where $m \geq 2$) surfaces, and a phase of a reflected wave in some of the m (where $m \geq 2$) surfaces and a phase of a reflected wave in the others of the m (where $m \geq 2$) surfaces have a phase difference of $n \cdot \pi + (1, 2, \ldots, \text{and } m-1) \cdot \pi / m$.

15. The electromagnetic wave propagation medium according to claim 14, wherein, when a wavelength of the electromagnetic wave in the electromagnetic wave propagation space is $\lambda$, some of the m (where $m \geq 2$) surfaces and the others of the m (where $m \geq 2$) surfaces are spaced apart from each other by a distance of $(1, 2, \ldots, \text{and } m-1) \cdot \lambda (2 \cdot m) + n \cdot \lambda / 2$ in the first direction or the second direction.

16. The electromagnetic wave propagation medium according to claim 15, wherein the m (where $m \geq 2$) surfaces form a single continuous surface.

17. The electromagnetic wave propagation medium according to claim 14, wherein the first conductive layer and the second conductive layer are short-circuited in some of the m (where $m \geq 2$) surfaces, and the first conductive layer and the second conductive layer are not short-circuited in the others of the m (where $m \geq 2$) surfaces.

18. The electromagnetic wave propagation medium according to claim 14, further comprising:

at least one electromagnetic wave input interface, wherein the more distant from the electromagnetic wave input interface is, the shorter the distance between a front surface of the first conductive layer and a rear surface of the second conductive layer is.

19. The electromagnetic wave propagation medium according to claim 14, further comprising:

at least one electromagnetic wave input interface; and a plurality of electromagnetic wave output interfaces, wherein, when a wavelength of the electromagnetic wave in the electromagnetic wave propagation space is $\lambda$, and n is an integer, in a case where the first conductive layer and the second conductive layer are short-circuited in an end surface which reflects the electromagnetic wave among the first end surfaces and the second end surfaces excluding end surfaces formed by the m (where $m \geq 2$) surfaces, the more distant the electromagnetic wave output interface is from the electromagnetic wave input interface, the closer to a distance of $\lambda/4 + n \cdot \lambda/2$ from the end surface the electromagnetic wave output interface is installed, and in a case where the first conductive layer and the second conductive layer are not short-circuited in the end surface, the more distant the electromagnetic wave output interface is from the electromagnetic wave input interface, the closer to a distance of $n \cdot \lambda/2$ from the end surface the electromagnetic wave output interface is installed.

20. The electromagnetic wave propagation medium according to claim 14, further comprising:

at least one electromagnetic wave input interface, wherein the first conductive layer, or the first conductive layer and the second conductive layer include mesh-shaped conductors, and wherein the more distant from the electromagnetic wave input interface the mesh-shaped conductors is, the sparser a mesh density of the mesh-shaped conductors is.

* * * * *